US006571073B1

(12) United States Patent
Suzuki et al.

(10) Patent No.: US 6,571,073 B1
(45) Date of Patent: May 27, 2003

(54) SUBUNIT ATTACHING STRUCTURE AND SUBUNIT ATTACHING/REMOVING METHOD IN IMAGE FORMING APPARATUS

(75) Inventors: Wataru Suzuki, Ebina (JP); Atsuyuki Kitamura, Ebina (JP); Junichirou Sameshima, Ebina (JP); Masaaki Tokunaga, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/875,886

(22) Filed: Jun. 8, 2001

(30) Foreign Application Priority Data

Jun. 9, 2000 (JP) ..... 2000-173624
Nov. 14, 2000 (JP) ..... 2000-347342

(51) Int. Cl.[7] ..... G03G 15/02
(52) U.S. Cl. ..... 399/116; 399/121; 399/124
(58) Field of Search ..... 399/110, 116, 399/117, 121, 124, 299, 306

(56) References Cited

U.S. PATENT DOCUMENTS 4,862,212 A * 8/1989 Tanzawa et al. ..... 399/110
5,041,872 A * 8/1991 Nukaya et al. ..... 347/138
5,065,195 A * 11/1991 Haneda et al. ..... 399/112
5,587,769 A * 12/1996 Sawada et al. ..... 399/101
5,652,942 A * 7/1997 Iseki et al. ..... 101/211
6,035,159 A * 3/2000 Azuma et al. ..... 399/111
6,101,349 A * 8/2000 Ohashi et al. ..... 399/110
6,115,568 A * 9/2000 Sameshima ..... 399/110
6,343,198 B1 * 1/2002 Sato ..... 399/121

FOREIGN PATENT DOCUMENTS

JP 6-110290 4/1994
JP 2000-128382 5/2000
JP 2000-310921 11/2000

* cited by examiner

*Primary Examiner*—Robert Beatty
(74) *Attorney, Agent, or Firm*—Morgan, Lewis & Bockius LLP

(57) ABSTRACT

There are plural subunits having a positional relationship that at least one of the subunits is located at such a position as to obstruct an operation of replacing another. There are provided positioning portions that are provided on the main body frame and position the respective subunits, and a subunit releasing mechanism that moves at least an outside subunit from a positioning and fixing position to a prescribed releasing position or a subunit fixing mechanism that holds the outside subunit at a prescribed releasing position and moves it from the released position to a prescribed, positioning and fixing position. Also provided is an axial movement prohibiting portion that prohibits in advance axial movement of a subunit before it is positioned. Further, a two-direction positioning portion is allowed to position a subunit preferentially over a one-direction positioning portion.

12 Claims, 33 Drawing Sheets

2 : BELT UNIT SEPARATED STATE

1 : FIXED STATE

2 : BELT UNIT SEPARATED STATE

3 : BELT UNIT AND PHOTORECEPTOR UNITS SEPARATED (RELEASED) STATE

1 : PHOTORECEPTOR UNITS RELEASED STATE

2 : AXIAL MOVEMENT OF PHOTORECEPTOR UNITS IS PROHIBITED

1 : BELT UNIT RELEASED STATE

2 : POSITIONING OF BELT UNIT IN AXIAL DIRECTION

3 : POSITIONING OF BELT UNIT IN X AND Y DIRECTIONS

4 : BELT UNIT FIXED STATE

1 : RELEASED STATE

2 : FIXED STATE

1 : RELEASED STATE

2 : FIXED STATE

1 : RELEASED STATE

2 : FIXED STATE

1 : RELEASED STATE

2 : FIXED STATE

2 : BELT UNIT SEPARATED STATE

3 : BELT UNIT AND PHOTORECEPTOR UNITS SEPARATED (RELEASED) STATE

SUBUNIT ATTACHING STRUCTURE AND SUBUNIT ATTACHING/REMOVING METHOD IN IMAGE FORMING APPARATUS

BACKGROUND OF THE INVENTION

1. Field of the Invention

The present invention relates to image forming apparatuses such as a copier and a printer. In particular, the invention relates to a subunit attaching structure and a subunit attaching/removing method that improve the workability of subunit replacement work in an image forming apparatus of a type in which a subunit for image formation is attached to a main body frame in a detachable manner.

2. Description of the Related Art

In conventional color image forming apparatuses, it is a common procedure that toner images of the respective color components are formed according to such an imaging method as electrophotography and then transferred to a recording member directly or via an intermediate transfer member so as to be superimposed one on another.

For example, tandem image forming apparatuses are known in which plural image carrying units (e.g., photoreceptor units in a case where electrophotography is employed) for formation of images of the respective color components that are yellow, magenta, cyan, and black, for example, are provided parallel and a belt unit as a transfer unit in which, for example, a transport belt that is wound on plural tension rollers circulates is opposed to the image carrying units. Toner images of the plural colors that are formed in the respective image carrying units are sequentially transferred to the transport belt of the belt unit or a recording member (a sheet of paper or an OHP sheet) that is placed on the transport belt so as to be superimposed one on another (e.g., Japanese Unexamined Patent Publication No. Hei. 6-110290).

In color image forming apparatuses of the above kind in which toner images of the respective color components are sequentially transferred to a recording member or an intermediate transfer member so as to be superimposed one on another, registration among the toner images of the respective color components is an important factor.

In particular, in tandem image forming apparatuses in which image carrying units are provided for the respective color components, they are associated with a technical problem that a registration error is prone to occur if a deviation occurs in the alignment between the main body frame and each image carrying unit or the belt unit.

To effectively prevent such a registration error, the present assignee proposed a technique that misalignment of each subunit is prevented by forming positioning portions for image carrying units and a belt unit integrally with a main body frame (Japanese Patent Application No. Hei. 11-241625), a technique that image carrying drums such as photoreceptor drums or a transport belt is prohibited from axial movement in a state that image carrying units or a belt unit is positioned and fixed (e.g., Japanese Unexamined Patent Publications Nos. 2000-310921 and 2000-128382), and other techniques.

Incidentally, in many image forming apparatuses of the above kind, image carrying units such as photoreceptor units are CRUs (customer replaceable units) that can be replaced by a user. In this case, naturally, work of replacing the image carrying units needs to be performed frequently.

In such a case, if work of replacing each image carrying unit can be performed independently of units around it, such work would be relatively easy.

However, due to a layout-related restriction such as a restriction that each image carrying unit needs to be located under the belt unit, there may occur, for example, a case that the belt unit needs to be located at such a position as to obstruct work of replacing the image carrying units.

In an image forming apparatus of the above type, before doing work of replacing the image carrying units, the belt unit that will obstruct such work needs to be moved away from the image carrying units.

Therefore, every time the image carrying units are to be replaced, it is necessary to remove the belt unit from the main body frame and then re-attach the belt unit to the main body frame after completion of replacement of the image carrying units. However, in image carrying unit replacement work, an operation of removing the belt unit each time and placing it outside the main body of the image forming apparatus and an operation of re-setting the belt unit that is placed outside the main body of the image forming apparatus after mounting of new image carrying units are very cumbersome.

When the image carrying units are replaced or the belt unit is removed to replace the image carrying units, it is necessary to again position and fix new image carrying units or the belt unit at its regular position in the main body frame. For example, in positioning an image carrying unit (or the belt unit) with respect to the main body frame and fixing the former to the latter, if the image carrying unit (or belt unit) is positioned with respect to the main body frame and fixed to the latter before the image carrying unit (or belt unit) is prohibited from axial movement, friction between the image carrying unit (or belt unit) and positioning portions of the main body frame makes it difficult to move smoothly the image carrying unit (or belt unit) to its axial movement prohibiting position, which is a factor of causing a registration error.

SUMMARY OF THE INVENTION

The present invention has been made in view of the above circumstances in the art, and provides a subunit attaching structure and a subunit attaching/removing method in an image forming apparatus that can improve the workability of subunit replacement work and position and fix a subunit at a regular position easily and correctly.

According to a first aspect of the invention, there is provided a subunit attaching structure of an image forming apparatus in which plural subunits for image formation are attached to a main body frame in a detachable manner with a positional relationship that at least one of the subunits is located at such a position as to obstruct an operation of replacing another, comprising positioning portions that are provided on the main body frame and position the respective subunits; and a subunit releasing mechanism that is used in releasing at least part of the subunits from a state that they are positioned with respect to and fixed to the associated positioning portion, and that moves at least an outside subunit that obstructs an operation of replacing an inside subunit from a positioning and fixing position to a prescribed releasing position.

According to a second aspect of the invention, there is provided a subunit removing method of an image forming apparatus in which plural subunits for image formation are attached to a main body frame in a detachable manner with a positional relationship that at least one of the subunits is located at such a position as to obstruct an operation of replacing another, comprising, to remove at least part of the subunits, an outside subunit releasing step of canceling at least a state that an outside subunit that obstructs an operation of replacing an inside subunit is fixed to an associated positioning portion and releasing the outside subunit from the positioning portion; and an inside subunit releasing step of canceling a state that the inside subunit is fixed to an associated positioning portion and releasing the inside subunit from the positioning portion at the same as or after at least the outside subunit releasing step is executed.

According to a third aspect of the invention, there is provided a subunit attaching structure of an image forming apparatus in which plural subunits for image formation are attached to a main body frame in a detachable manner with a positional relationship that at least one of the subunits is located at such a position as to obstruct an operation of replacing another, comprising positioning portions that are provided on the main body frame and position the respective subunits; and a subunit fixing mechanism that is used in positioning at least part of the subunits being in a released state with respect to the associated positioning portions and fixing the former to the latter, and that holds at least an outside subunit that obstructs an operation of replacing an inside subunit at a prescribed releasing position and moves the outside subunit from the prescribed releasing position to a prescribed, positioning and fixing position.

According to a fourth aspect of the invention, there is provided a subunit attaching method of an image forming apparatus in which plural subunits for image formation are attached to a main body frame in a detachable manner with a positional relationship that at least one of the subunits is located at such a position as to obstruct an operation of replacing another, to attach at least part of the subunits, comprising, to attach at least part of the subunits, an inside subunit fixing step of positioning at least an inside subunit with respect to an associated positioning portion and fixing the former to the latter; and an outside subunit fixing step of positioning, with respect to an associated positioning portion, an outside subunit to be located outside the inside subunit and fixing the former to the latter, the outside subunit fixing step being executed after at least the positioning of the inside subunit fixing step is performed.

According to a fifth aspect of the invention, there is provided a subunit attaching structure of an image forming apparatus in which plural subunits for image formation are attached to a main body frame in a detachable manner with a positional relationship that at least one of the subunits is located at such a position as to obstruct an operation of replacing another, comprising positioning portions that are provided on the main body frame and position the respective subunits; a subunit releasing mechanism that is used in releasing at least part of the subunits from a state that they are positioned with respect to and fixed to the associated positioning portion, and that moves at least an outside subunit that obstructs an operation of replacing an inside subunit from a prescribed, positioning and fixing position to a prescribed releasing position; and a subunit fixing mechanism that is used in positioning at least part of the subunits being in a released state with respect to the associated positioning portions and fixing the former to the latter, and that holds at least the outside subunit that obstructs an operation of replacing the inside subunit at the prescribed releasing position and moves the outside subunit from the prescribed releasing position to the prescribed, positioning and fixing position, wherein the subunit releasing mechanism and the subunit fixing mechanism are a single mechanism.

According to a sixth aspect of the invention, there is provided a subunit attaching structure of an image forming apparatus in which a subunit for image formation is attached to a main frame body in a detachable manner, comprising a positioning portion that is provided on the main body frame and positions the subunit, the positioning portion comprising an axial movement prohibiting portion that prohibits in advance axial movement of the subunit before the subunit is positioned.

According to a seventh aspect of the invention, there is provided a subunit attaching structure of an image forming apparatus in which a subunit for image formation is attached to a main frame body in a detachable manner, comprising a two-direction positioning portion that prohibits movement of the subunit in a height direction and a horizontal direction on the main body frame; and a one-direction positioning portion that prohibits movement of the subunit only in the height direction, wherein the subunit is positioned preferentially with respect to the two-direction positioning portion over the one-direction positioning portion.

BRIEF DESCRIPTION OF THE DRAWINGS

Preferred embodiments of the present invention will be described in detail based on the following figures, wherein.

DESCRIPTION OF THE PREFERRED EMBODIMENTS

Figure 1:
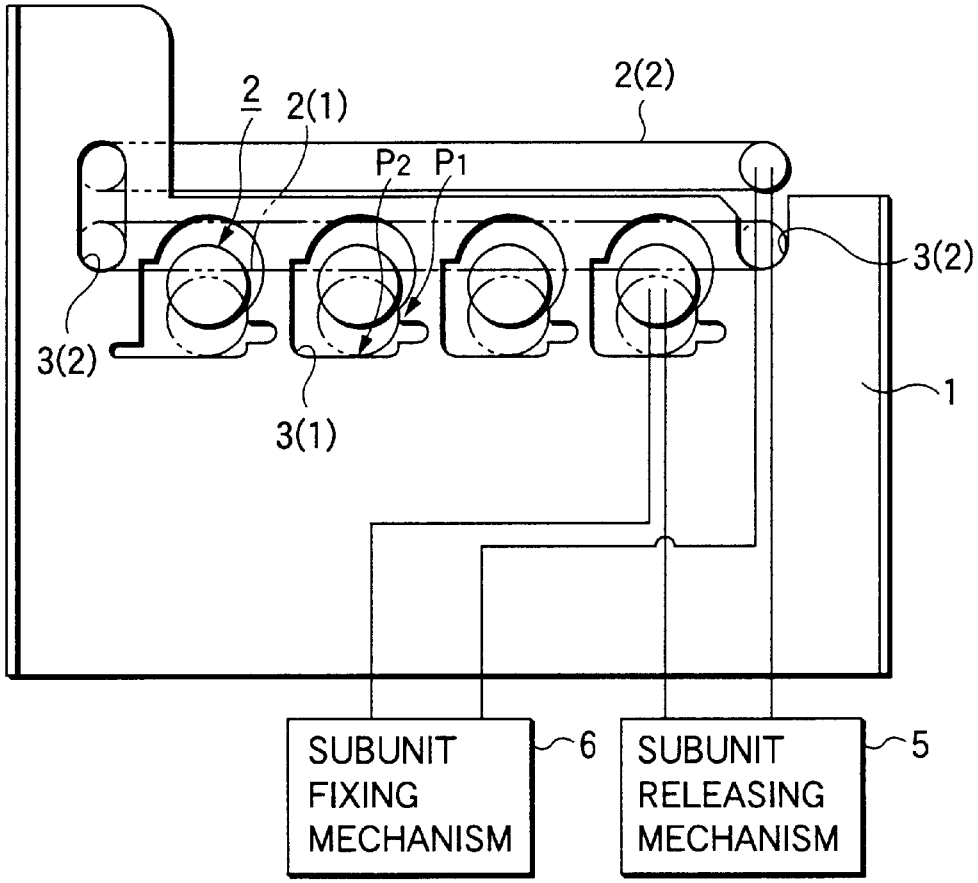
FIG. 1 outlines subunit attaching structures of an image forming apparatus according to the present invention.

A first exemplary basic configuration of the present invention is as follows. As shown in FIG. 1, in an image forming apparatus in which plural subunits 2 (e.g., 2(1) and 2(2)) for image formation are attached to a main body frame 1 in a detachable manner with a positional relationship that at least one of the subunits 2 is located at such a position as to obstruct an operation of replacing another, an attaching structure that is necessary for removing the subunits 2 is provided. Specifically, there are provided positioning portions 3 (e.g., 3(1) and 3(2)) that are provided on the main body frame 1 and position the respective subunits 2, and a subunit releasing mechanism 5 that is used in releasing at least part of the subunits 2 from a state that they are positioned with respect to and fixed to the associated positioning portion 3 and that moves at least an outside subunit 2(2) that obstructs an operation of replacing an inside subunit 2(1) from a positioning and fixing position to a prescribed releasing position.

In the above configuration, the main body frame 1 may be a frame to serve as a reference of positioning and supporting of the subunits 2 and is usually formed by fixing to each other plural sheet metal parts by welding or a like unit.

The subunits 2 broadly include subunits for image formation such as an image carrying unit (e.g., a photoreceptor unit), a transfer unit (e.g., a belt unit), a latent image forming unit, a registration unit, a fusing unit, and a sensor unit. However, the invention is directed to plural subunits 2 (e.g., 2(1) and 2(2)) having a positional relationship that at least one of the subunits 2 is located at such a position as to obstruct an operation of replacing another. In the example of FIG. 1, the inside subunit 2(1) is an image carrying unit and the outside subunit 2(2) is a belt unit as a transfer unit.

The positioning portion 3 may be of any structure such as a positioning hole, a positioning boss, a positioning groove, or a positioning surface as long as it can position and support the associated subunit 2.

The positioning portion 3 is not limited to ones that are integral with the main body frame 1 and includes ones that are separate from the main body frame 1. From the viewpoint of increasing the positioning accuracy, it is preferable that the positioning portion 3 be integral with the main body frame 1.

Each of the subunits 2 corresponding to the respective positioning portions 3 needs to have a positioning subject portion to engage the associated positioning portion 3. The positioning subject portion may be an independent positioning portion of each subunit 2, or part of each subunit 2 (for example, in an image forming apparatus in which drum-shaped image carrying bodies are provided as the inside subunits 2(1), the positioning subject portion may be an end outer circumferential portion of each image carrying body, a bearing member for holding the outer circumferential portion rotatably, or the like).

Although in FIG. 1 reference symbol 3(1) denotes a positioning portion of the inside subunit 2(1) and 3(2) denotes a positioning portion of the outside subunit 2(2), they are just examples.

The subunit releasing mechanism 5 may be any mechanism as long as it releases at least the outside subunit 2(2) and include ones that do not release the inside subunit 2(2) (the inside subunit 2(1) is released manually).

It is preferable that the subunit releasing mechanism 5 be so configured as to release not only the outside subunit 2(2) but also the inside subunit 2(1). In this case, the subunit releasing mechanism 5 may be one that is used in releasing each of the subunits 2(1) and 2(2) from a state that it is positioned with respect to and fixed to the associated positioning portion 3 and moves each of the subunits 2(1) and 2(2) from a positioning and fixing position to a prescribed releasing position.

As for the operation required for the subunit releasing mechanism 5, it is preferable that the mechanism operates according to a prescribed releasing procedure.

A method for removing plural subunits 2 in an image forming apparatus having such a subunit releasing mechanism 5 is as follows.

As shown in FIG. 1, in an image forming apparatus in which plural subunits 2 (2(1) and 2(2)) for image formation are attached to a main body frame 1 in a detachable manner with a positional relationship that at least one of the subunits 2 is located at such a position as to obstruct an operation of replacing another, to remove at least part of the subunits 2, there are provided an outside subunit releasing step of canceling at least a state that an outside subunit 2(2) that obstructs an operation of replacing an inside subunit 2(1) is fixed to an associated positioning portion 3(2) and releasing the outside subunit 2(2) from the positioning portion 3(2), and an inside subunit releasing step of canceling a state that the inside subunit 2(1) is fixed to an associated positioning portion 3(1) and releasing the inside subunit 2(1) from the positioning portion 3(l) at the same as or after at least the outside subunit releasing step is executed.

Although the releasing of the inside subunit releasing step should be performed at the same time as or after the execution of the outside subunit releasing step, whichever of the fixed state canceling of the outside subunit releasing step and that of the inside subunit releasing step may be performed earlier.

A second exemplary basic configuration of the invention is as follows. As shown in FIG. 1, in an image forming apparatus in which plural subunits 2 (e.g., 2(1) and 2(2)) for image formation are attached to a main body frame 1 in a detachable manner with a positional relationship that at least one of the subunits 2 is located at such a position as to obstruct an operation of replacing another, an attaching structure that is necessary for fixing the subunits 2 is provided. Specifically, there are provided positioning portions 3 (3(1) and 3(2)) that are provided on the main body frame 1 and position the respective subunits 2, and a subunit fixing mechanism 6 that is used in positioning at least part of the subunits 2 being in a released state with respect to the associated positioning portions 3 and fixing the former to the latter and that holds at least an outside subunit 2(2) that obstructs an operation of replacing an inside subunit 2(1) at a prescribed releasing position and moves the outside subunit 2(2) from the prescribed releasing position to a prescribed, positioning and fixing position.

In the above configuration, the main body frame 1, the subunits 2, and the positioning portions 3 have the same meanings as in the first exemplary basic configuration. The subunit fixing mechanism 6 may be any mechanism as long as it moves at least the outside subunit 2(2) from the releasing position to the fixing position, and include ones that do not contribute an operation of fixing the inside subunit 2(1) (the inside subunit 2(1) is fixed manually).

It is preferable that the subunit fixing mechanism 6 be so configured as to fix not only the outside subunit 2(2) but also the inside subunit 2(1). In this case, the subunit releasing mechanism 6 may be one that is used in positioning each of the subunits 2(1) and 2(2) with respect to the associated positioning portion 3 and fixing the former to the latter, and holds each of the subunits 2 at a prescribed releasing position and moves each of the subunits 2 from the prescribed releasing position to a prescribed, positioning and fixing position.

As for the operation required for the subunit fixing mechanism 6, it is preferable that the mechanism operates according to a prescribed fixing procedure.

A method for attaching plural subunits 2 in an image forming apparatus having such a subunit releasing mechanism 6 is as follows.

As shown in FIG. 1, in an image forming apparatus in which plural subunits 2 (2(1) and 2(2)) for image formation are attached to a main body frame 1 in a detachable manner with a positional relationship that at least one of the subunits 2 is located at such a position as to obstruct an operation of replacing another, to attach at least part of the subunits 2, there are provided an inside subunit fixing step of positioning at least an inside subunit 2(1) with respect to an associated positioning portion 3(1) and fixing the former to the latter, and an outside subunit fixing step of positioning, with respect to an associated positioning portion 3(2), an outside subunit 2(2) to be located outside the inside subunit 2(1) and fixing the former to the latter, the outside subunit fixing step being executed after at least the positioning of the inside subunit fixing step is performed.

Although the positioning of the outside subunit fixing step should be performed after the execution of the inside subunit fixing step, whichever of the fixing of the inside subunit fixing step and that of the outside subunit fixing step may be performed earlier.

A preferable example as a combination of the first and second exemplary basic configurations is as follows. As shown in FIG. 1, in an image forming apparatus in which plural subunits 2 (e.g., 2(1) and 2(2)) for image formation are attached to a main body frame 1 in a detachable manner with a positional relationship that at least one of the subunits 2 is located at such a position as to obstruct an operation of replacing another, there are provided positioning portions 3 (e.g., 3(1) and 3(2)) that are provided on the main body frame 1 and position the respective subunits 2, a subunit releasing mechanism 5 that is used in releasing at least part of the subunits 2 from a state that they are positioned with respect to and fixed to the associated positioning portion 3 and that moves at least an outside subunit 2(2) that obstructs an operation of replacing an inside subunit 2(1) from a prescribed, positioning and fixing position to a prescribed releasing position, and a subunit fixing mechanism 6 that is used in positioning at least part of the subunits 2 being in a released state with respect to the associated positioning portions 3 and fixing the former to the latter and that holds at least the outside subunit 2(2) that obstructs an operation of replacing the inside subunit 2(1) at the prescribed releasing position and moves the outside subunit 2(2) from the prescribed releasing position to the prescribed, positioning and fixing position, wherein the subunit releasing mechanism 5 and the subunit fixing mechanism 6 are a single mechanism.

In this configuration, importance is given to simplification of the apparatus configuration in improving the subunit replacement work.

A configuration that is preferable in terms of keeping the positioned and fixed states of the subunits 2 is such that the subunit releasing mechanism 5 or the subunit fixing mechanism 6 is provided with a fixing force generating portion that generates fixing force for positioning and fixing the subunits 2.

In this case, it is preferable that in releasing each of the subunits 2 the fixing force of the fixing force generating portion be able to be canceled by weak manipulation force.

Another exemplary basic configuration of the invention is preferable in terms of stabilizing the subunit positioning accuracy. For example, as shown in FIG. 1, in an image forming apparatus in which a subunit 2 for image formation is attached to a main frame body 1 in a detachable manner, a positioning portion 3 that positions the subunit 2 is provided on the main body frame 1 and the positioning portion 3 is provided with an axial movement prohibiting portion that prohibits in advance axial movement of the subunit 2 before the subunit 2 is positioned.

This example is different from the first and second examples in that in this example presence of plural subunits 2 is not a precondition. And this example is intended to improve the structure for positioning the subunit 2.

Still another exemplary basic configuration of the invention is preferable in terms of preventing a twist of a subunit and thereby keep high positioning performance. For example, as shown in FIG. 1, in an image forming apparatus in which a subunit 2 for image formation is attached to a main frame body 1 in a detachable manner, there are provided a two-direction positioning portion (e.g., one of the portions denoted by symbol 3(2)) as a positioning portion 3 on the main body frame 1 that prohibits movement of the subunit 2 (e.g., 2(2)) in two directions that are a height direction and a horizontal direction, and a one-direction positioning portion (e.g., the other of the portions denoted by symbol 3(2)) that prohibits movement of the subunit 2 only in the height direction, wherein the subunit 2(2) is positioned preferentially with respect to the two-direction positioning portion over the one-direction positioning portion.

This example is also different from the first and second examples in that in this example presence of plural subunits 2 is not a precondition. And this example is intended to improve the structure for positioning the subunit 2.

The term "to position preferentially" means that the one-direction positioning portion absorbs a horizontal positioning error with the position of the two-direction positioning portion as a reference, and broadly includes fixing positioning order, providing a difference in pressing force, and providing a difference in sliding resistance.

The invention will be hereinafter described in detail by using an embodiment that is illustrated by the drawings.

Figure 2:
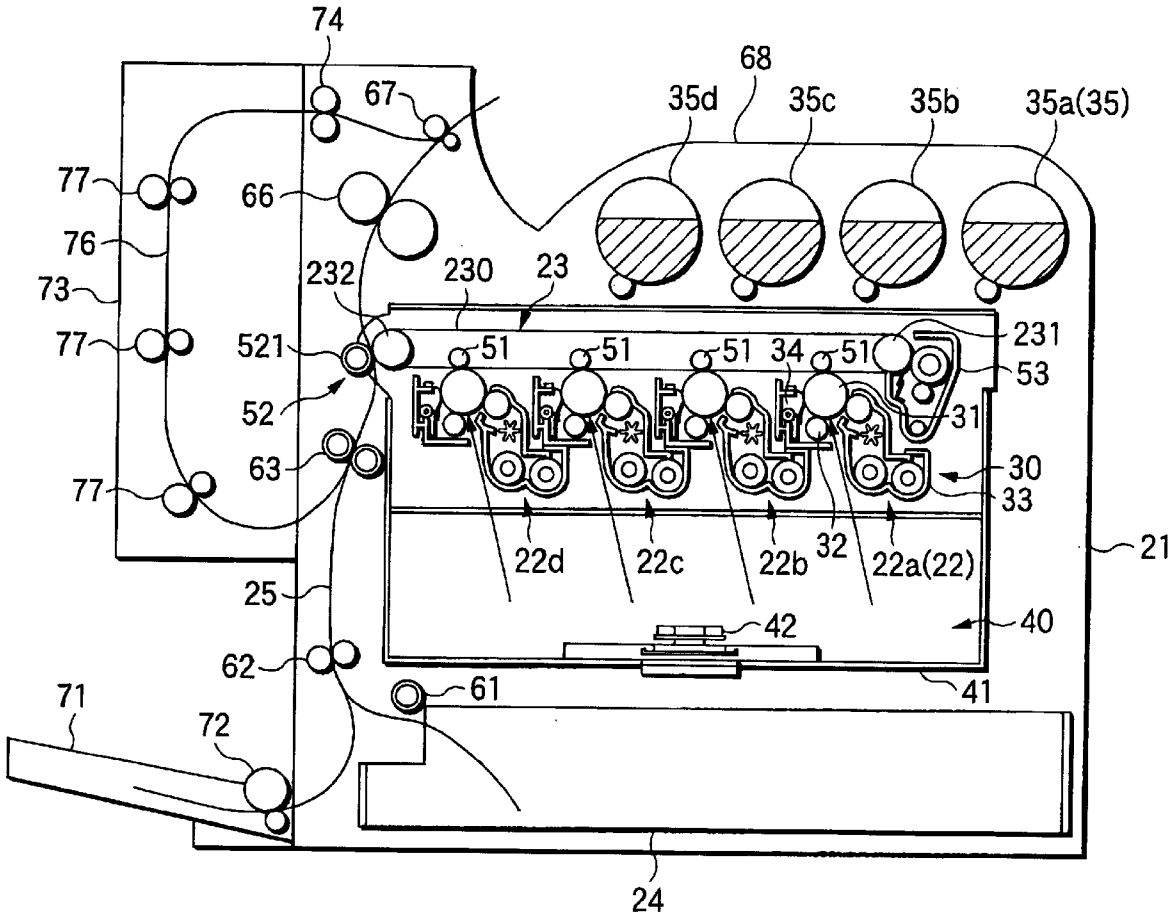
FIG. 2 shows the entire configuration of an image forming apparatus according to an embodiment of the invention.

FIG. 2 shows a tandem image forming apparatus according to an embodiment of the invention.

As shown in FIG. 2, in the tandem image forming apparatus, image forming units 22 (specifically, 22*a*–22*d*) of four colors (in this embodiment, black, yellow, magenta, and cyan) are arranged in the horizontal direction inside a main body housing 21. A belt unit 23 as a transfer unit that includes an intermediate transfer belt 230 that is circulated so as to move in the arrangement direction of the image forming units 22 is disposed above the image forming units 22. On the other hand, a recording member supply cassette 24 for accommodating recording members (not shown) such as sheets is disposed under the main body housing 21. A recording member transport path 25 as a transport path of a recording member supplied from the recording member supply cassette 24 is provided in the vertical direction.

In this embodiment, the image forming units 22 (22*a*–22*d*) for forming toner images of black, yellow, magenta, and cyan are arranged in this order downstream in the circulation direction of the intermediate transfer belt 230 (the arrangement order is not limited to the above one). The image forming units 22 have respective photoreceptor units 30, respective developing units 33, and a common, single exposing unit 40.

For example, each photoreceptor unit 30 is formed by integrating, into a cartridge form, a photoreceptor drum 31, a charger (in this example, a charging roller) 32 for charging the photoreceptor drum 31 in advance, and a cleaner 34 for removing toner remaining on the photoreceptor drum 31. As such, the photoreceptor unit 30 is what is called a CRU (customer replaceable unit).

Each developing unit 33 develops, with a corresponding color toner (in this embodiment, a negative one, for example), an electrostatic latent image that is formed on the charged photoreceptor drum 31 through exposure with the exposing unit 40.

Reference symbol 35 (35*a*–35*d*) denotes toner cartridges for supplying toners of the respective color components to the respective developing units 33.

On the other hand, the exposing unit 40 is configured as follows. For example, four semiconductor lasers (not shown), one polygon mirror 42, an imaging lens (not shown), and mirrors (not shown) corresponding to the respective photoreceptor units 30 are accommodated in a unit case 41. A light beam emitted from the semiconductor laser of each color component is scan-deflected by the polygon mirror 42, whereby an optical image is guided to an exposure point on the corresponding photoreceptor drum 31 via the imaging lens and the mirror.

In this embodiment, the belt unit 23 is configured in such a manner that the intermediate transfer belt 230 is wound on a proper number of (e.g., a pair of) tension rollers 231 and 232 (one of which is a driving roller). Primary transfer devices (in this example, primary transfer rollers) 51 are disposed on the back side of the intermediate transfer belt 230 at positions corresponding to the photoreceptor drums 31 of the respective photoreceptor units 30. A toner image on each photoreceptor drum 31 is transferred electrostatically to the intermediate transfer belt 230 by applying a voltage that is reverse in polarity to the toner charging polarity to the associated primary transfer device 51.

Further, a secondary transfer device 52 is disposed at a position corresponding to the tension roller 232 that is located downstream of the image forming unit 22*d* that is the last one of the image forming units 22 in the transport direction of the intermediate transfer belt 230. Primary transfer images on the intermediate transfer belt 230 are secondarily transferred (en bloc) to a recording member.

In this embodiment, the secondary transfer device 52 is provided with a secondary transfer roller 521 that is disposed so as to be pressed against the toner image carrying surface of the intermediate transfer belt 230 and a backup roller (in this example, it also serves as the tension roller 232) that is disposed on the back surface side of the intermediate transfer belt 230 and serves as a counter electrode for the secondary transfer roller 521.

For example, the secondary transfer roller 521 is grounded and a bias having the same polarity as the toner charging polarity is applied to the backup roller (tension roller 232).

A belt cleaner 53 is disposed upstream of the image forming unit 22*a* that is the first one of the image forming units 22 in the transport direction of the intermediate transfer belt 230. The belt cleaner 53 removes toner that remains on the intermediate transfer belt 230.

The recording member supply cassette 24 is provided with a feed roller 61 for picking up a recording member. Take-away rollers 62 for feeding a recording member are disposed immediately downstream of the feed roller 61. The part of the recording member transport path 25 that is located immediately upstream of the secondary transfer position is provided with registration rollers 63 for supplying a recording member to the secondary transfer position with prescribed timing.

Reference numeral 72 denotes feed rollers for feeding a manually fed recording member.

On the other hand, the part of the recording member transport path 25 that is located downstream of the secondary transfer position is provided with a fusing device 66. Ejection rollers 67 for ejecting a recording member are disposed downstream of the fusing device 66. Ejected recording members are accommodated in an accommodation tray 68 that is formed as a top portion of the main body housing 21.

In this embodiment, a manual feed supply device (MSI) 71 is provided on one side surface of the main body housing 21. A recording member on the manual feed supply device 71 is fed to the recording member transport path 25 by the feed rollers 72 and the take-away rollers 62.

A double-sided recording unit 73, which is attached to the main body housing 21, operates in the following manner. When a double-sided recording mode has been selected in which image recording is performed on both surfaces of a recording member, the double-sided recording unit 73 captures a recording member whose one surface has been subjected to recording by reversely rotating the ejection rollers 67 and rotating guide rollers 74 that are located upstream of the inlet. The recording member is transported along an internal recording member return transport path 76 by a proper number of pairs of transport rollers 77 and then returned to the registration rollers 63.

Figure 3:
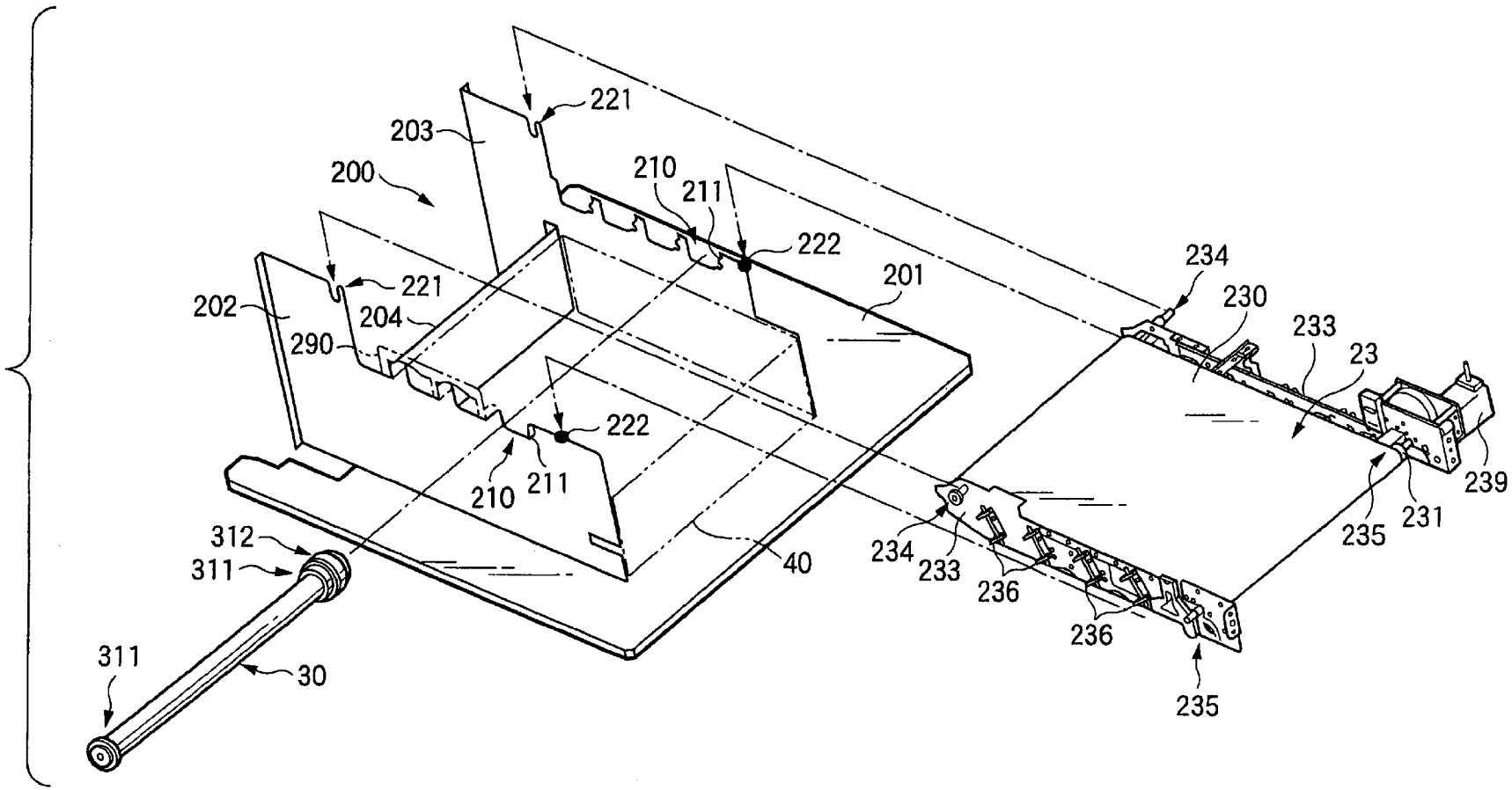
FIG. 3 is an exploded perspective view showing the structures of a main body frame and positioning portions of photoreceptor units and a belt unit that are used in the embodiment.

In this embodiment, as shown in FIG. 3, the photoreceptor units 30, the belt unit 23, and the exposing unit 40 (indicated by two-dot chain lines in FIG. 3) are directly positioned with respect to a main body frame 200 that is part of the chassis of the main body housing 21.

As shown in FIG. 3, the main body frame 200 has a base frame 201 as a base plate. A pair of separate main frames 202 and 203 erect from the base frame 201 at front and rear positions. A proper number of (in this example, one) support frame 204 is disposed between the main frames 202 and 203. The base frame 201, the main frames 202 and 203, and the support frame 204 constitute an accommodation portion for the exposing unit 40.

In this embodiment, the top peripheral portions of the main frames 202 and 203 are formed with positioning portions 210 for positioning the photoreceptor drums 31 of the four photoreceptor units 30.

Figure 4:
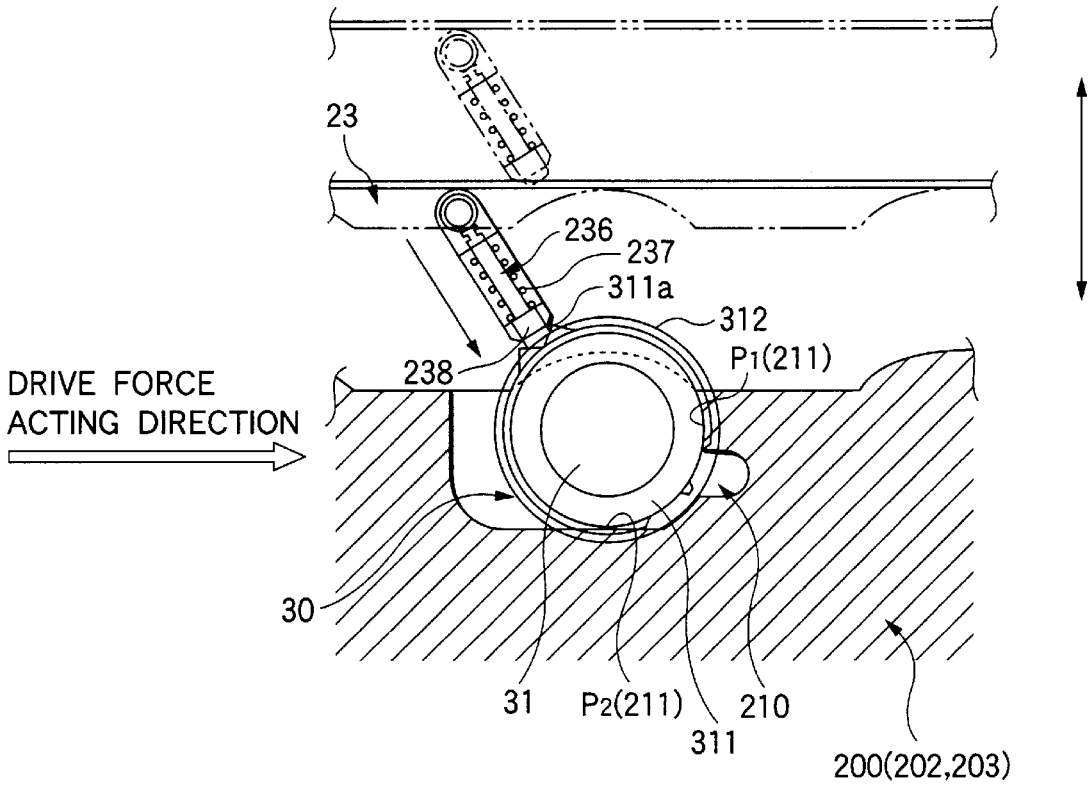
FIG. 4 shows details of a positioning portion for a photoreceptor unit and a fixing device.

For example, as shown in FIGS. 3 and 4, each positioning portion 210 is a cut having a generally V-shaped V block 211 for supporting an end outer circumferential portion of the photoreceptor drum 31 or a bearing 311 (in this example, a bearing 311) at two points P1 and P2. Reference numeral 312 denotes a driving gear of the photoreceptor drum 31.

The point P1 of the V block 211 is provided against drive force (its direction is indicated by an arrow in FIG. 4) that acts in a radial direction of the photoreceptor drum 31 in driving it.

Where the rigidity of the main frames 202 and 203 is insufficient in the configuration in which the top peripheral portions of the main frames 202 and 203 are formed with the positioning portions 210 that are cuts, a rigidity increasing portion 290, for example, may be provided at all or part (in this example, the two inside ones) of the positioning portions 210 that are the four cuts for each of the main frames 202 and 203, as indicated by imaginary lines in FIG. 3.

An example of the rigidity increasing members 290 is such that an E-shaped connection portion is provided above the two positioning portions 210 in an integral manner and then the connecting portion is bent.

As shown in FIG. 3, the top peripheral portions of the main frames 202 and 203 are also formed with positioning portions 221 and 222 for the belt unit 23.

In this embodiment, the belt unit 23 has a unit frame 233 in which at least one pair of side plate frames are opposed to each other. The tension rollers 231 and 232 (see FIG. 2) bridge the side plate frames of the unit frame 233, and the intermediate transfer belt 230 is wound on the tension rollers 231 and 232. The side plate frames of the unit frame 233 are provided, at positions close to the tension roller 231, with respective positioning legs 235 as positioning subject portions that project downward. The side plate frames of the unit frame 233 are also provided, at positions close to the tension roller 232, with respective positioning bosses 234 as positioning subject portions that project outward in the axial direction of the tension roller 232.

In this embodiment, each positioning portion 221 is a positioning groove with which the associated positioning boss 234 of the belt unit 23 is to engage. On the other hand, each positioning portion 222 is a positioning surface to be mounted with the associated positioning leg 235 of the belt unit 23.

Instead of the positioning bosses 234, bearings provided at both ends of the tension roller 232 may be used as positioning subject portions. In FIG. 3, reference numeral 239 denotes a driving motor for the intermediate transfer belt 230.

In this embodiment, the positioning accuracy of the positioning portions 210, 221, and 222 is at such a level that registration errors between toner images of the respective color components are made as small as about 125 $\mu$m, for example.

In this embodiment, the belt unit 23 is configured in such a manner that a subunit releasing/fixing mechanism 500 (described later) can cause it to escape from the main body frame 200 in the vertical direction (or through rotation). Pressing members 236 for pressing the photoreceptor drums 31 are attached to the outside surfaces of the respective side plate frames of the unit frame 233.

For example, as shown in FIG. 4, each pressing member 236 has a pressing rod 238 that is urged by a spring 237 in the pressing direction (specifically, in the direction in which to press the associated photoreceptor drum 31 toward the support points P1 and P2 of the associated V block 211). For example, the pressing rod 238 butts a portion 311*a* of each of the bearings 311 provided at both ends of the photoreceptor drum 31.

When the photoreceptor units 30 are to be replaced (removed), the belt unit 23 is escaped from the main body frame 200 from the position indicated by solid lines in FIG. 4 to the position indicated by imaginary lines and then the photoreceptor units 30 are taken away. When new photoreceptor units 30 are to be mounted, the belt unit 23 is engaged with the main body frame 200 (i.e., the belt unit 23 is positioned), whereby the pressing members 236 that are attached to the belt unit 23 press the photoreceptor drums 31 against the V blocks 211 of the main body frame 200.

Next, a description will be made of the work of replacing the photoreceptor units 30 of the image forming apparatus according to the invention.

Figure 5:
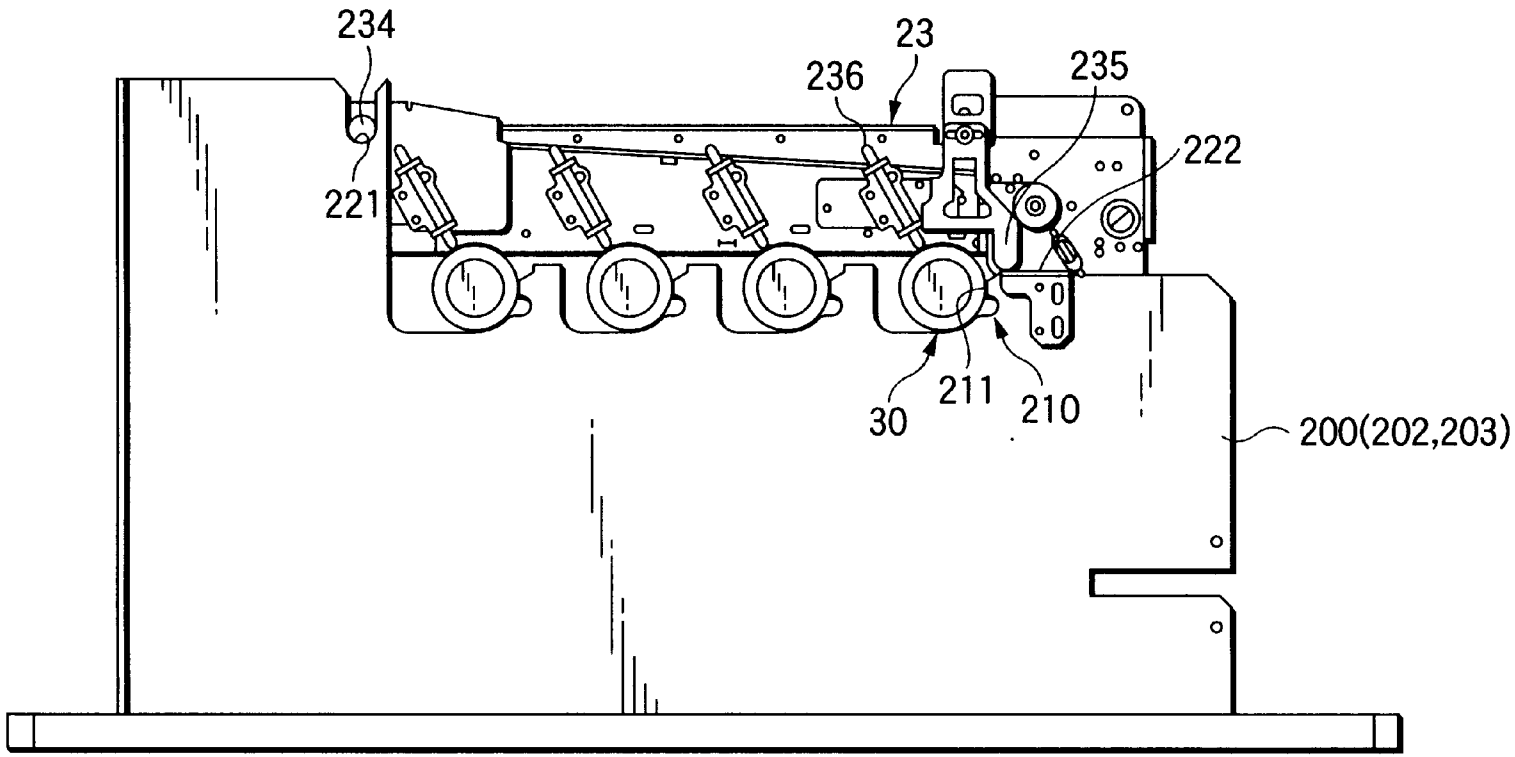
FIG. 5 shows a state that the photoreceptor units and the belt unit of the image forming apparatus according to the embodiment are fixed.

Now, assume that as shown in FIG. 5 the photoreceptor units 30 and the belt unit 23 are positioned with respect to and fixed to the main body frame 200 (specifically, the main frames 202 and 203). The belt unit 23 is located at such a position as to obstruct an operation of replacing each photoreceptor unit 30.

Figure 6:
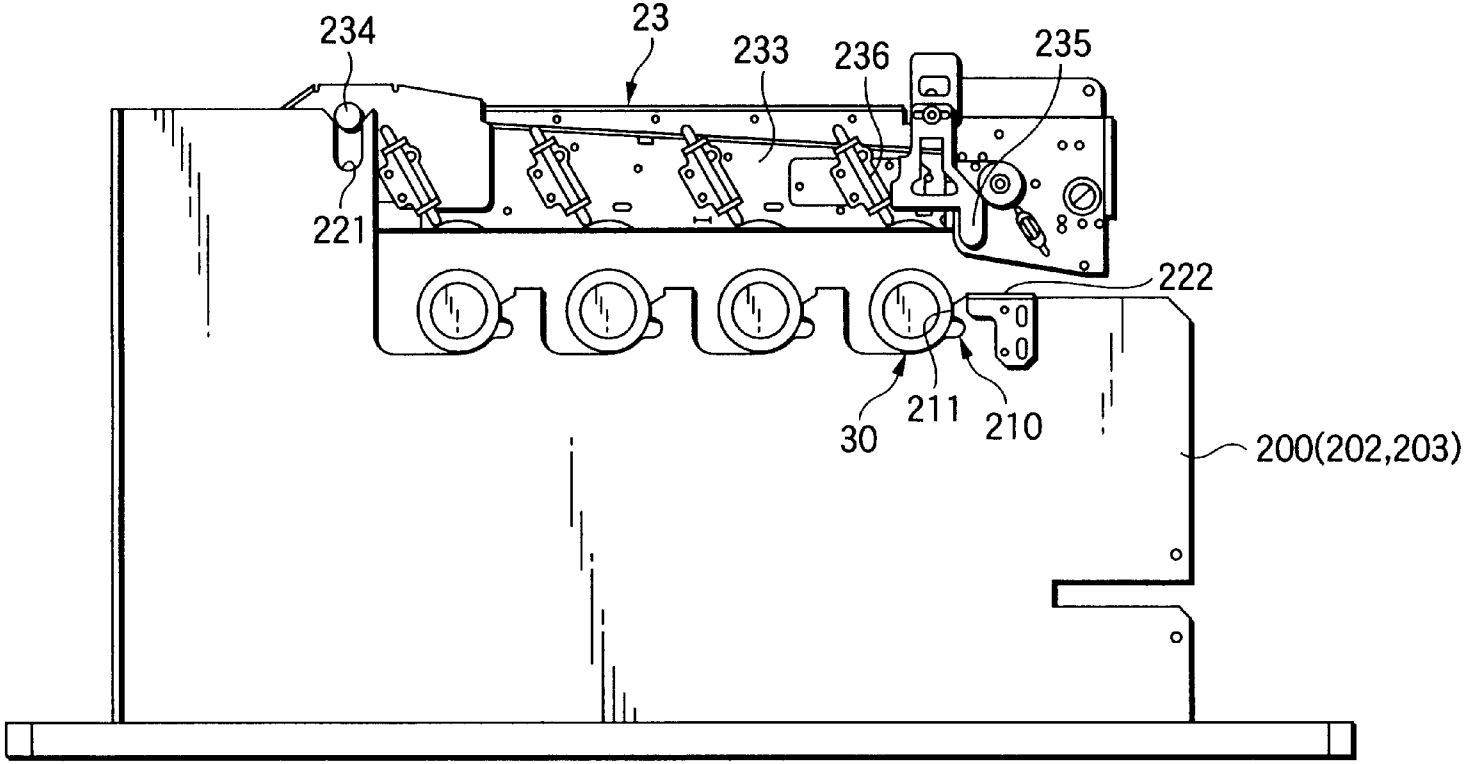
FIG. 6 shows a state that the belt unit of the image forming apparatus according to the embodiment is separated.
Figure 7:
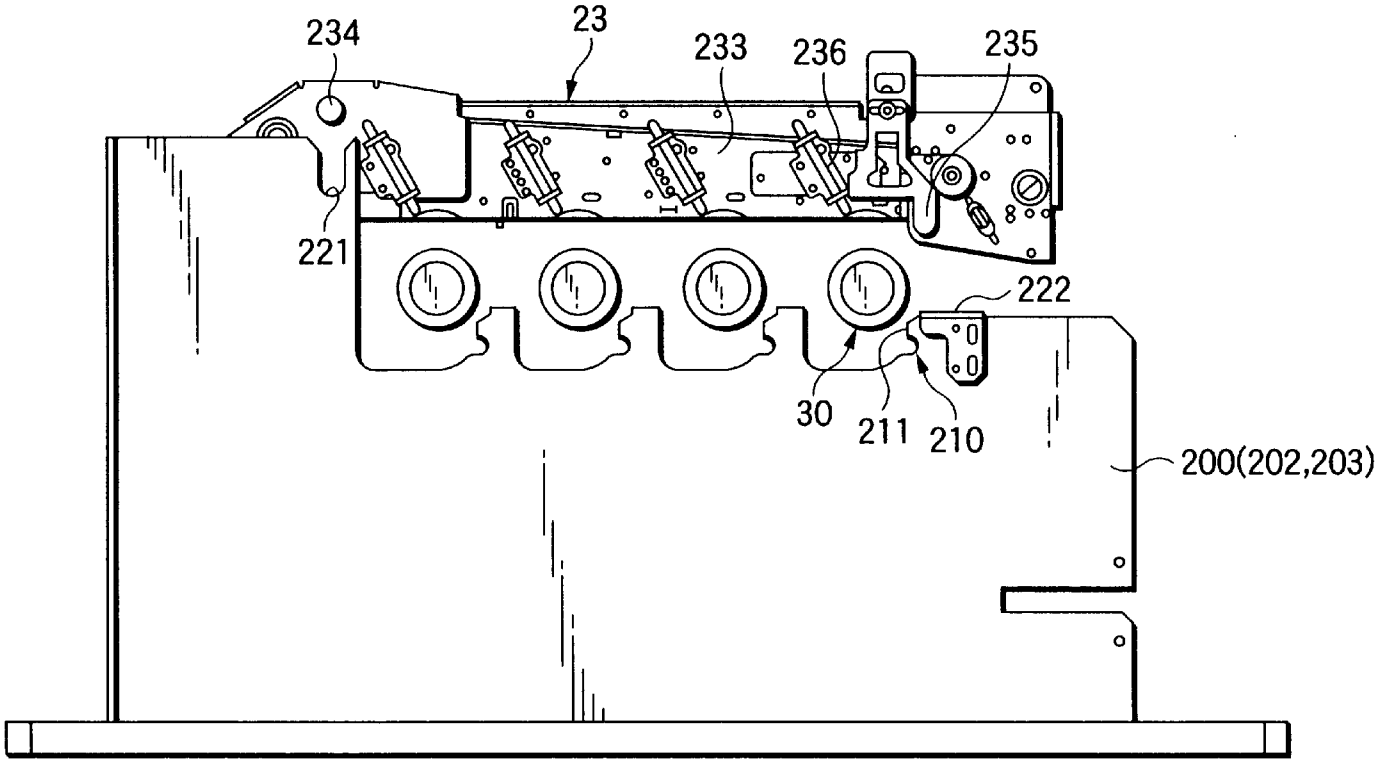
FIG. 7 shows a state that the photoreceptor units and the belt unit of the image forming apparatus according to the embodiment are separated (released)

Therefore, to replace the photoreceptor units 30, first, as shown in FIG. 6, the fixed state of the belt unit 23 that is positioned with respect to and fixed to the positioning portions 221 and 222 of the main body frame 200 is canceled. Thereafter, the belt unit 23 is separated from the positioning portions 221 and 222, and then the photoreceptor units 30 that are positioned with respect to the positioning portions 210 of the main body frame 200 are separated from the positioning portions 210 as shown in FIG. 7 and removed. In this example, in a state that the belt unit 23 is separated from the positioning portions 221 and 222, the pressing actions of the pressing members 236 for fixing the photoreceptor units 30 are canceled as indicated by the imaginary lines in FIG. 4, for example. Therefore, the fixed states of the photoreceptor units 30 to the positioning portions 210 have already been canceled.

Thereafter, as shown in FIG. 6, new photoreceptor units 30 are positioned with respect to the positioning portions 210 of the main body frame 200 with the belt unit 23 kept separated from the main body frame 200. Then, as shown in FIG. 5, the belt unit 23 is positioned with respect to and fixed to the positioning portions 221 and 222 of the main body frame 200 and the photoreceptor units 30 are fixed by the pressing members 236.

In particular, this embodiment employs the positioning method in which in the above work of replacing the photoreceptor units 30 the photoreceptor units 30 and the belt unit 23 are already prohibited from axial movement at the stage that they are positioned with respect to the main body frame 200. This type of work of replacing the photoreceptor units 30 is performed easily by means of the subunit releasing/fixing mechanism 500 (described later) in a state that the positioning accuracy is kept high.

The individual items will be described below one by one.

[1] Photoreceptor units positioning method

In this embodiment, the positioning method for the photoreceptor units 30 is such that positioning in the X and Y directions (in the plane perpendicular to the axial direction) is performed by using the positioning portions 210 of the main body frame 200, and that axial movement is prohibited by axial movement prohibiting portions 212 that are disposed in the vicinity of the positioning portions 210 (see FIGS. 8–10).

Each axial movement prohibiting portion 212 is configured as follows. One of the main frames 202 and 203 of the main body frame 200 is provided with a position restriction plate 213 having an L-shaped cross-section for restricting the position of one end of the associated photoreceptor unit 30 (in this example, the center of one end of the associated photoreceptor drum 31). The other of the main frames 202 and 203 is provided with a structure in which a movable restriction block 214 for restricting movement of the other end of the photoreceptor unit 30 (in this example, a portion of a unit case 313) is elastically urged by an urging spring 215.

The movable restriction block 214 has a positioning slant surface 214*a*. The unit case 313 of the photoreceptor unit 30 is formed with a slant engagement portion 313*a* having a slant surface similar to the positioning slant surface 214*a* at the position corresponding to the positioning slant surface 214*a*.

Figure 8A:
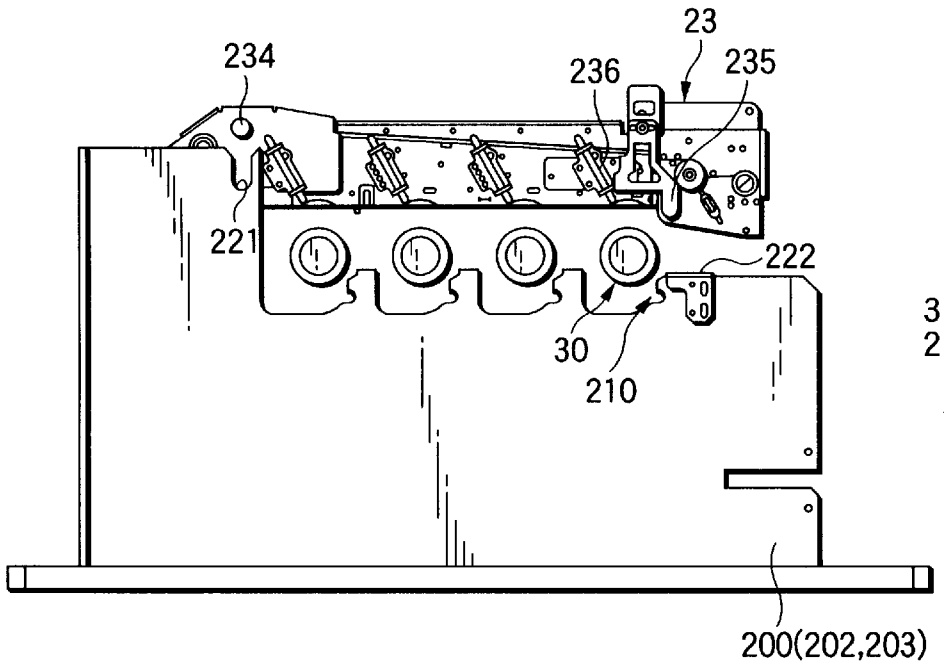
FIGS. 8A and 8B are a front view and a side view, respectively, showing step 1 (released state) of a process of positioning the photoreceptor units of the image forming apparatus according to the embodiment.
Figure 8B:
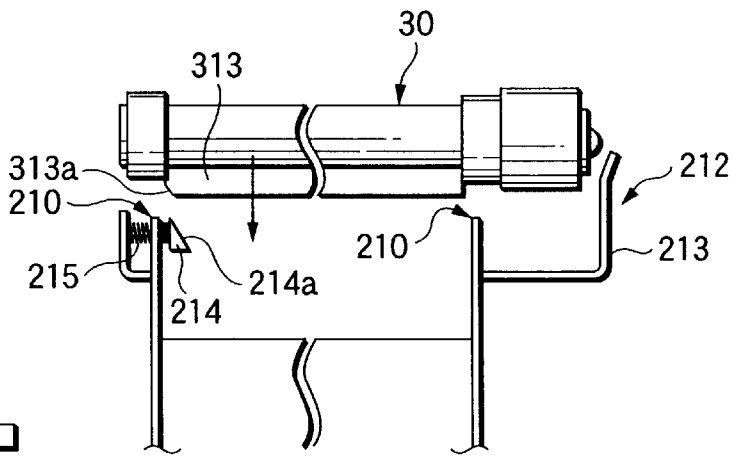
Figure 9A:
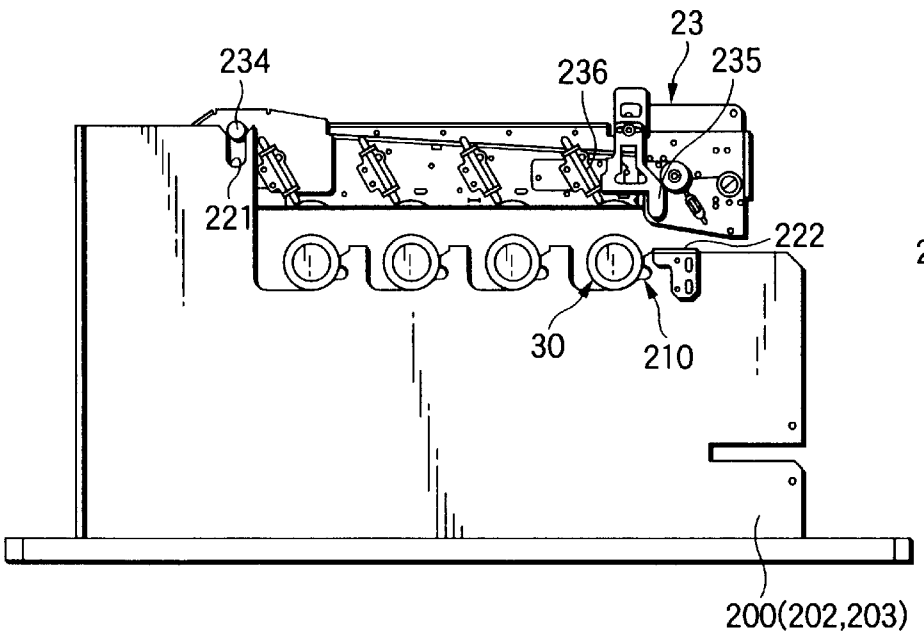
FIGS. 9A and 9B are a front view and a side view, respectively, showing step 2 (the photoreceptor units are prohibited from axial movement) of the process of positioning the photoreceptor units of the image forming apparatus according to the embodiment.
Figure 9B:
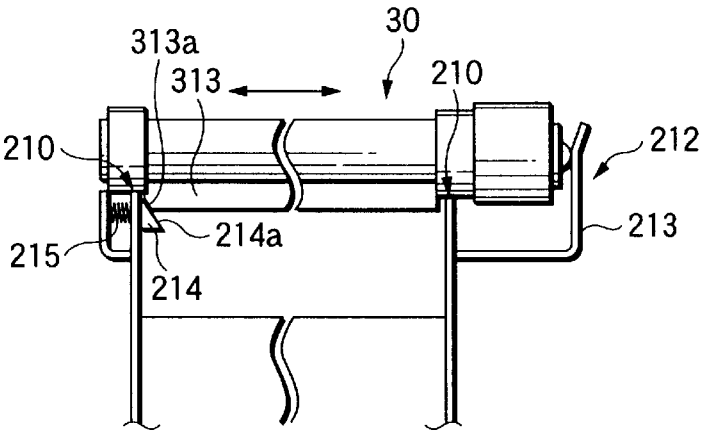

Therefore, in this embodiment, if the photoreceptor units 30 are in a released state as shown in FIGS. 8A and 8B, the photoreceptor units 30 are positioned by lowering the separated photoreceptor units 30 toward the respective pairs of positioning portions 210 as shown in FIGS. 9A and 9B.

At this time, before the photoreceptor units 30 are positioned with respect to the positioning portions 210, the axial movement prohibiting portions 212 operate and the photoreceptor units 30 are thereby prohibited from axial movement.

That is, whereas the position of one end of each photoreceptor unit 30 in the axial direction is restricted by the position restriction plate 213, the slant engagement portion 313*a* of the unit case 313 of the photoreceptor unit 30 engages the movable restriction block 214 and the photoreceptor unit 30 is urged toward the position restriction plate 213 by the urging action of the urging spring 215. As a result, the photoreceptor unit 30 is prohibited from movement being confined between the position restriction plate 213 and the movable restriction block 214 that is urged by the urging spring 215. When each photoreceptor unit 30 is positioned with respect to the positioning portions 210, the axial position of the photoreceptor unit 30 is fixed at the regular position.

Figure 10A:
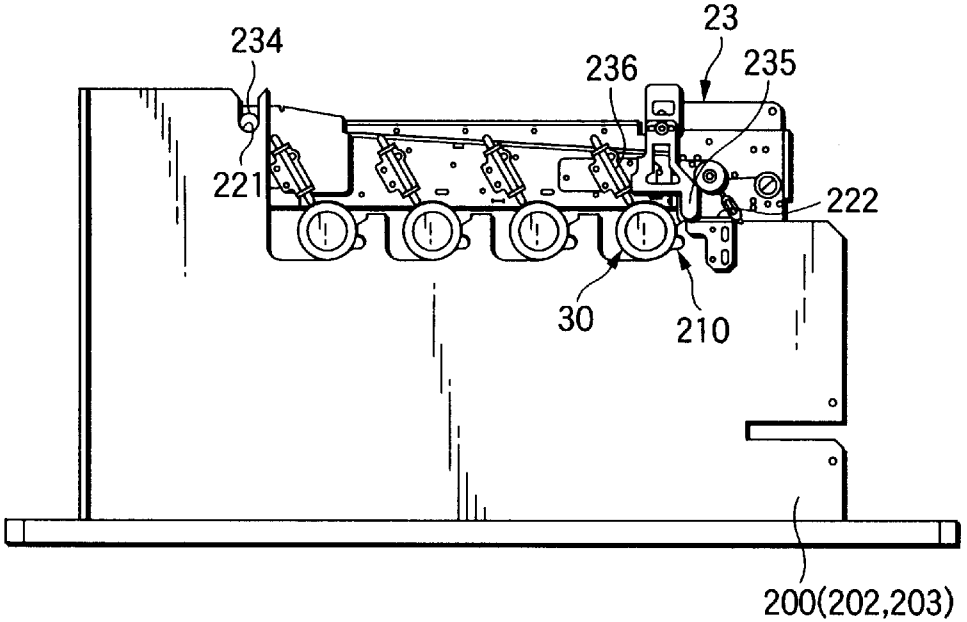
FIGS. 10A and 10B are a front view and a main part perspective view, respectively, showing step 3 (the photoreceptor units are fixed) of the process of positioning the photoreceptor units of the image forming apparatus according to the embodiment.
Figure 10B:
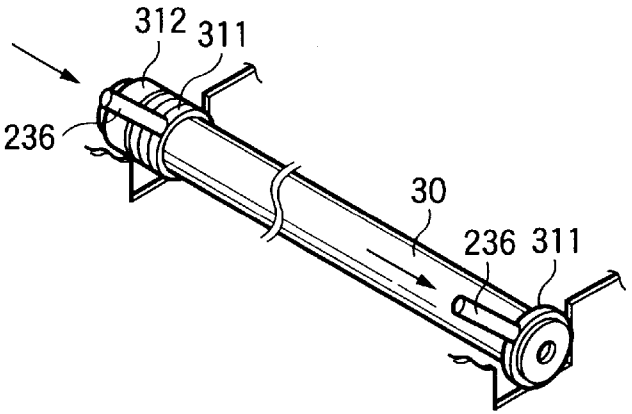

Thereafter, if the belt unit 23 is positioned and fixed and the pressing members 236 of the belt unit 23 press the photoreceptor units 30 that are positioned with respect to the positioning portions 210 as shown in FIGS. 10A and 10B, the photoreceptor units 30 are positioned with respect to and fixed to the positioning portions 210.

[2] Belt unit positioning method

In this embodiment, the positioning method for the belt unit 23 is such that that positioning in the X and Y directions (in the plane perpendicular to the axial direction) is performed by using the positioning portions 221 and 222 of the main body frame 200, and that axial movement of the belt unit 23 is prohibited by an axial movement prohibiting portion 223 as shown in FIGS. 11A and 11B to FIGS. 14A and 14B, for example.

In particular, in this embodiment, the axial movement prohibiting portion 223 is so configured as to prohibit axial movement of the belt unit 23 by using the positioning bosses 234 that are provided on the side plate frames of the unit frame 233. It goes without saying that separate members for movement prohibition may be provided instead of using the positioning bosses 234.

The axial movement prohibiting portion 223 of this embodiment is configured as follows. A fixing position restriction member 251 that touches and guides the tip of one positioning boss 234 is provided at a position corresponding to one positioning portion 221 of the main body frame 200. A movable position restriction member 255 that touches and guides the tip of the other positioning boss 234 is provided at a position corresponding to the other positioning portion 221 of the main body frame 200.

In this example, the fixed position restriction member 251 has a guide groove 252 that the tip portion of the associated positioning boss 234 is to engage. The guide groove 252 is formed with a position restriction surface 253 that touches and guides the tip of the positioning boss 234.

On the other hand, the movable position restriction member 255 has a fixed guide member 256 that is formed with a guide groove 257. The guide groove 257 of the fixed guide member 256 has a cut at the bottom and a movable body 258 such as a roller body that is urged by an urging spring 259 and can project and retract in the axial direction of the belt unit 23 is provided in the cut.

In FIGS. 11A and 11B to 14A and 14B, reference numeral 260 denotes a belt unit fixing function portion that is a schematically drawn version of a function portion for fixing the belt unit 23 and that is part of the subunit releasing/fixing mechanism 500 (described later). The belt unit fixing function portion 260 exerts prescribed fixing forces to the belt unit 23 via pressing springs 261.

Figures 11A, 11B:
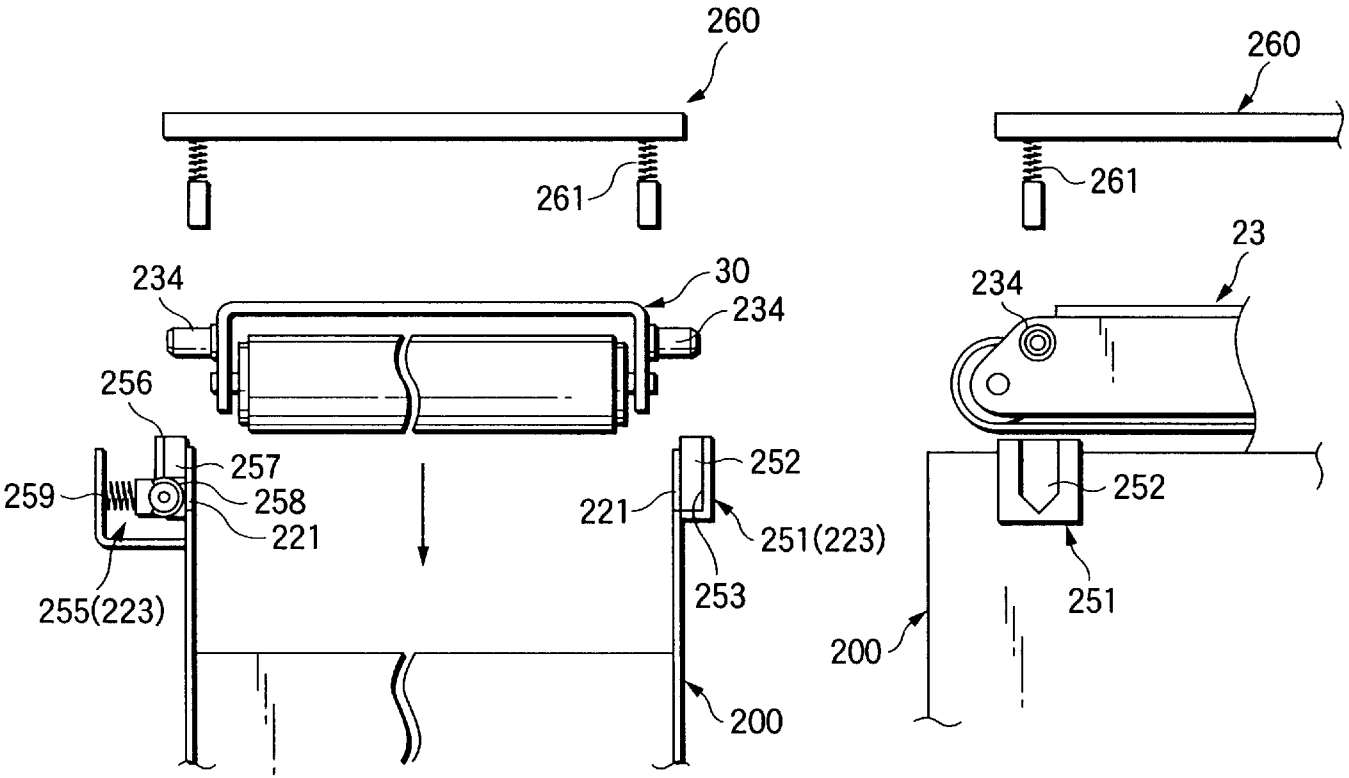
FIGS. 11A and 11B are a side view and a main part rear view, respectively, showing step 1 (belt unit released state) of a process of positioning the belt unit of the image forming apparatus according to the embodiment.

Therefore, in this embodiment, if the belt unit 23 is in a released state as shown in FIGS. 11A and 11B, the belt unit 23 is positioned by lowering the belt unit 23 toward the positioning portions 221 and 222 of the main body frame 200 as shown in FIGS. 11A and 11B and causing the positioning bosses 234 and the positioning legs 235 of the belt unit 23 to engage the pairs of positioning portions 221 and the pairs of positioning portions 222, respectively.

At this time, before the positioning bosses 234 of the belt unit 23 are positioned with respect to the positioning portions 221 of the main body frame 200, the axial movement prohibiting portion 223 operates and the belt unit 23 is thereby prohibited from axial movement.

Figures 12A, 12B:
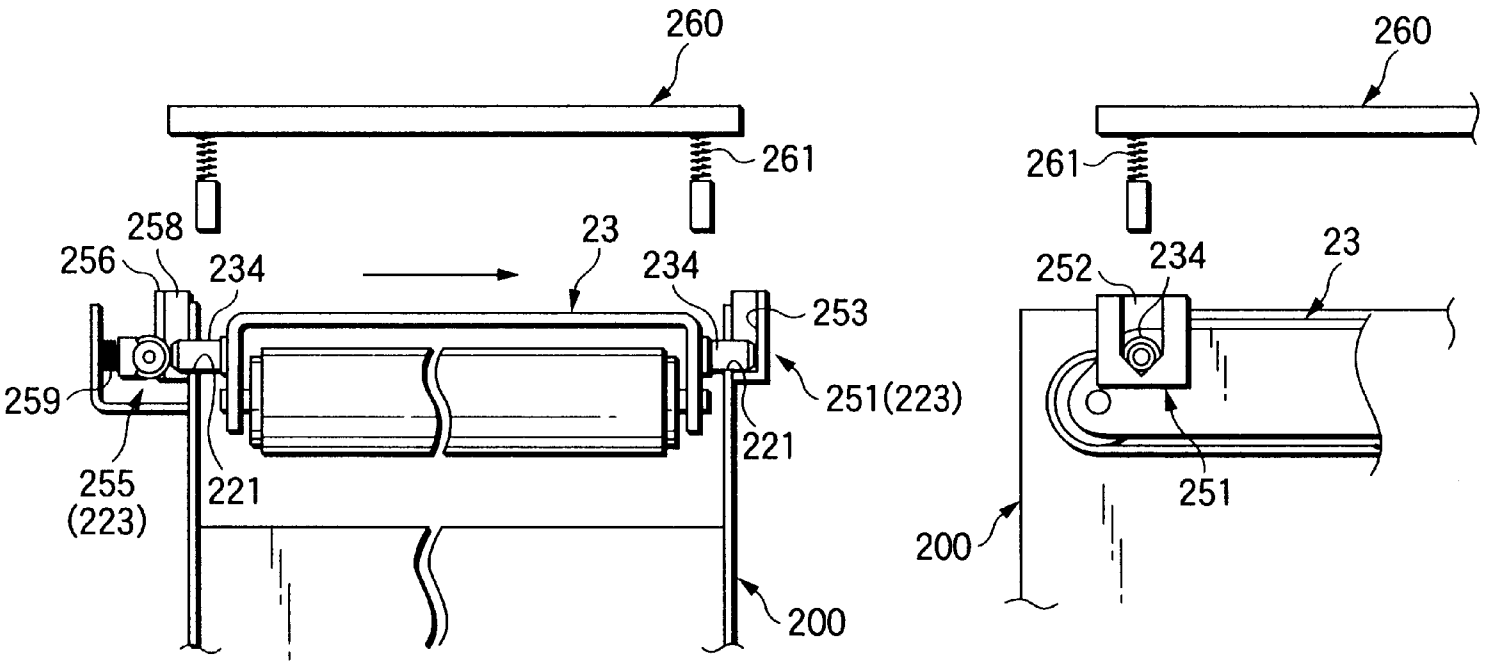
FIGS. 12A and 12B are a side view and a main part rear view, respectively, showing step 2 (the belt unit is positioned in the axial direction) of the process of positioning the belt unit of the image forming apparatus according to the embodiment.

That is, as shown in FIGS. 12A and 12B, whereas the tip of the one positioning boss 234 of the belt unit 23 is restricted by the fixed position restriction member 251, the other positioning boss 234 of the belt unit 23 touches the movable body 258 of the movable position restriction member 255 and the belt unit 23 is urged toward the fixed position restriction member 251 by the urging force of the urging spring 259. As a result, the belt unit 23 is prohibited from movement being confined between the fixed position restriction member 251 and the movable body 258 that is urged by the urging spring 259 of the movable position restriction member 255. The axial position of the belt unit 23 is fixed at the regular position in the process that the belt unit 23 is positioned with respect to the positioning portions 221 and 222.

Figures 13A, 13B:
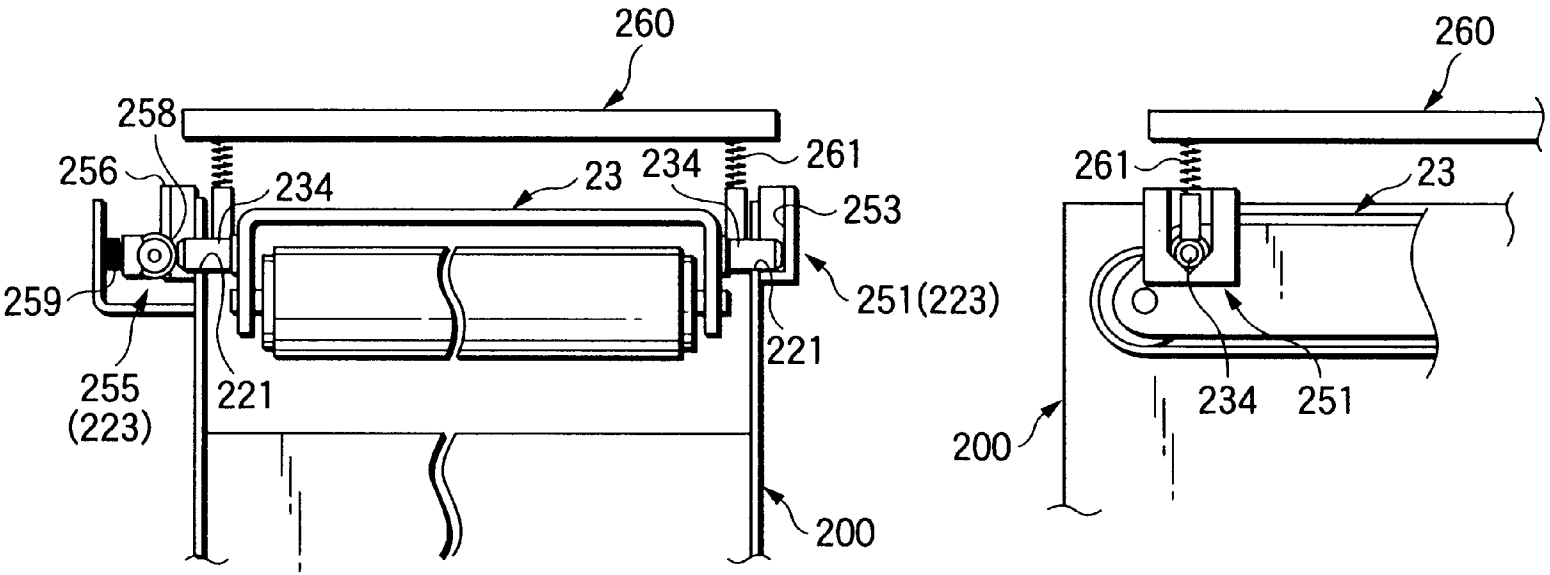
FIGS. 13A and 13B are a side view and a main part rear view, respectively, showing step 3 (the belt unit is positioned in the X and Y directions) of the process of positioning the belt unit of the image forming apparatus according to the embodiment.

Thereafter, as shown in FIGS. 13A and 13B, the belt unit fixing function portion 260 starts functioning, whereby the belt unit 23 is completely engaged with the positioning portions 221 and 222 of the main body frame 200 and positioned in the X and Y directions while being prohibited from axial movement.

Figure 14A:
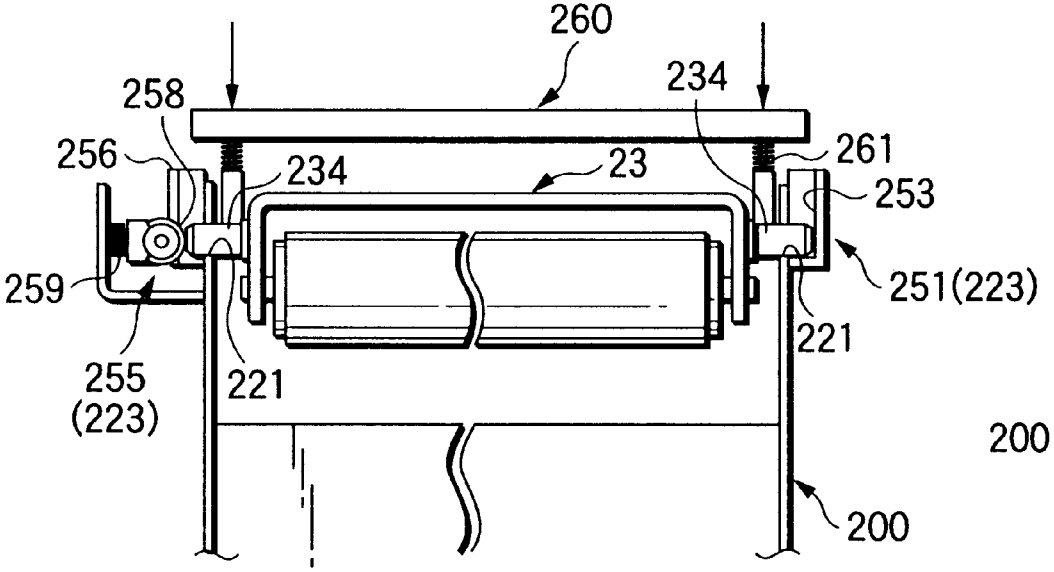
FIGS. 14A and 14B are a side view and a main part rear view, respectively, showing step 4 (belt unit fixed state) of the process of positioning the belt unit of the image forming apparatus according to the embodiment.
Figure 14B:
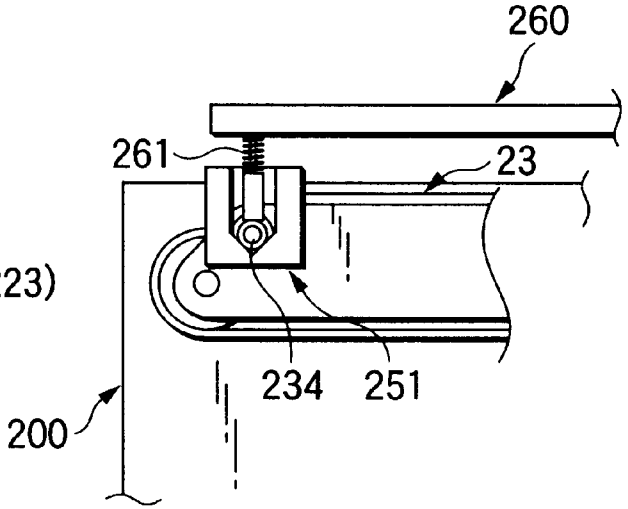

As shown in FIGS. 14A and 14B, when the belt unit fixing function portion 260 functions completely, the fixing forces of the pressing springs 261 are exerted on the belt unit 23, whereby the belt unit 23 is positioned with respect to and fixed to the positioning portions 221 and 222 in a reliable manner.

As described above, in tandem image forming apparatuses like the one according to the invention, it is necessary that the alignment accuracy of the tension rollers 231 and 232 of the belt unit 23 (although in this example it is the intermediate transfer belt unit, the same is true of a recording member transport belt unit) be kept high. In this embodiment, the positioning method for the belt unit 23 is such that the positioning portions 221 (i.e., the positioning grooves that the respective positioning bosses 234 are to engage) serve to prohibit the belt unit 23 from moving in the X and Y directions (X direction: belt running direction (horizontal direction); Y direction: height direction), that the positioning portions 222 (i.e., the positioning surfaces to be mounted with the respective positioning legs 235) restrict the position of the belt unit 23 in the Y direction (height direction), and that the axial movement prohibiting portion 223 prohibits the belt unit 23 from moving in the Z direction (axial direction).

As shown in FIGS. 11A and 11B to FIGS. 14A and 14B, the positioning procedure for the belt unit 23 includes the following operations that are written in time-series order:

(1) Positioning in the Z direction (axial direction) using the axial movement prohibiting portion 223.

(2) Positioning in the X and Y directions (belt running direction and height direction) using the positioning portions 221 and 222.

(3) Pressing and fixing by the belt unit fixing function portion 260 (having the push-down function using the pressing springs 261).

The above procedure prevents deformation of the belt unit 23 and misalignment of the tension rollers 231 and 232.

Figure 15:
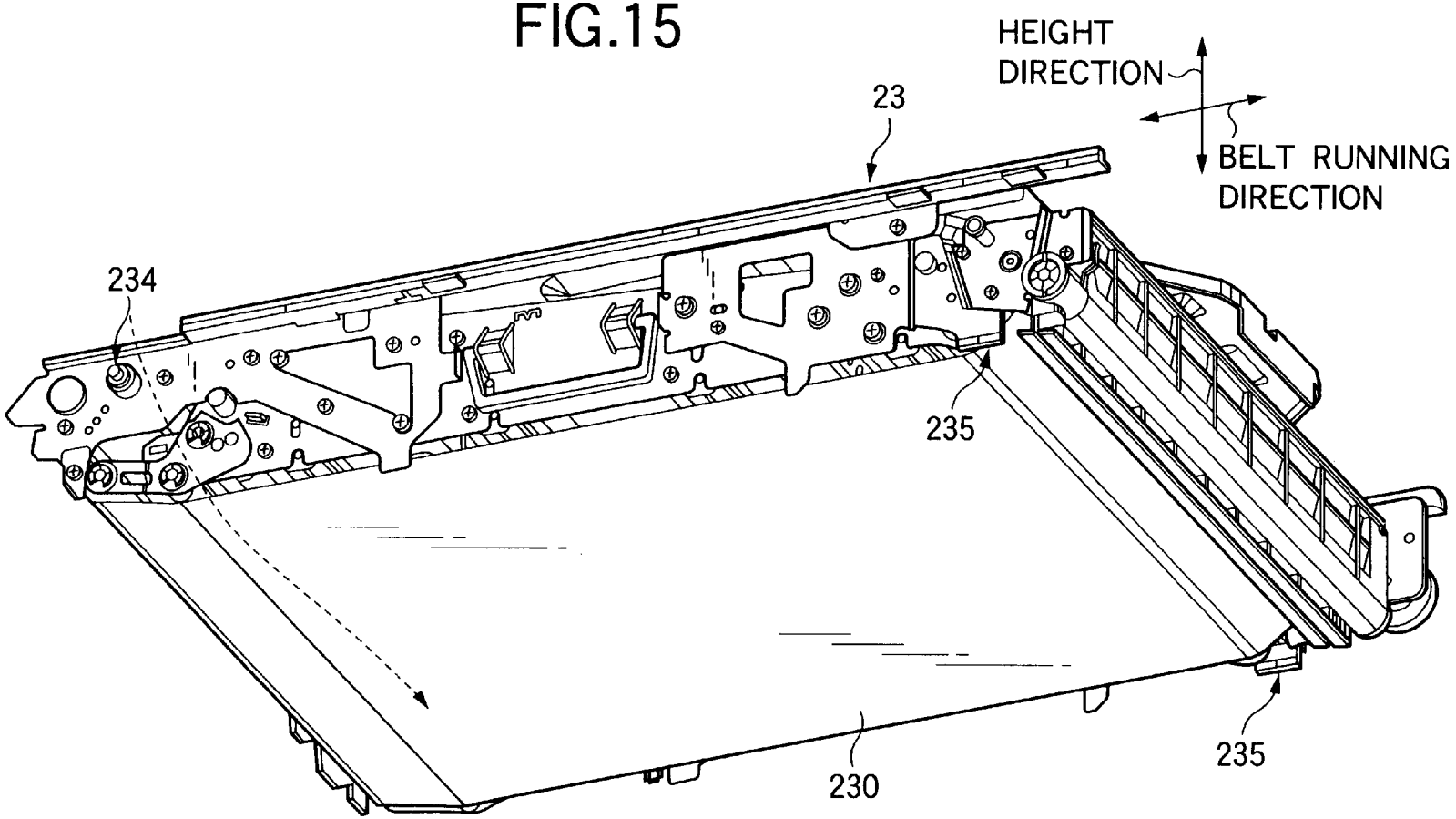
FIG. 15 is a perspective view, as viewed obliquely from below, of the belt unit that is used in the embodiment.
Figure 16:
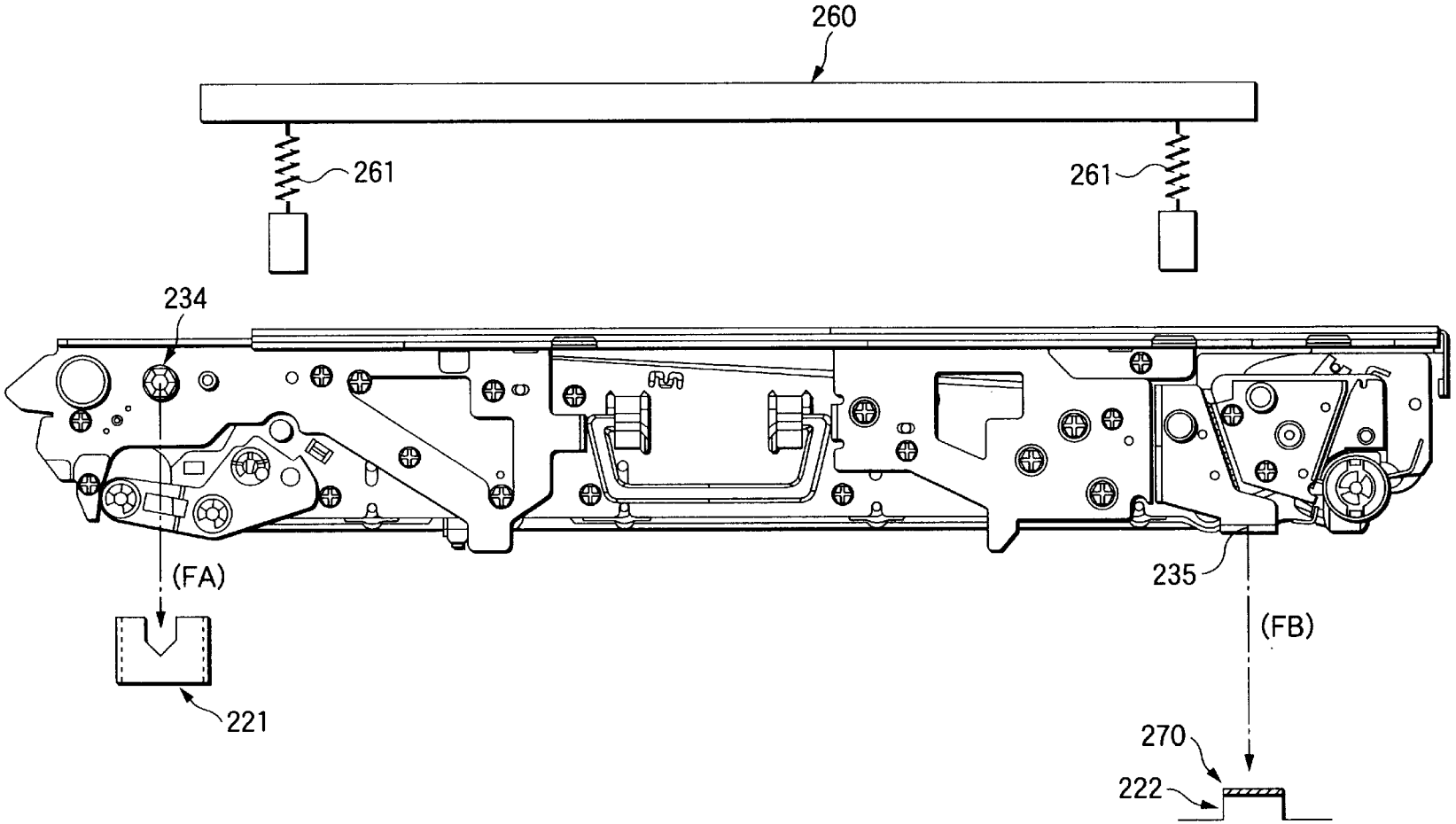
FIG. 16 is a front view showing how the belt unit that is used in the embodiment is positioned and fixed in the X and Y directions.
Figure 17:
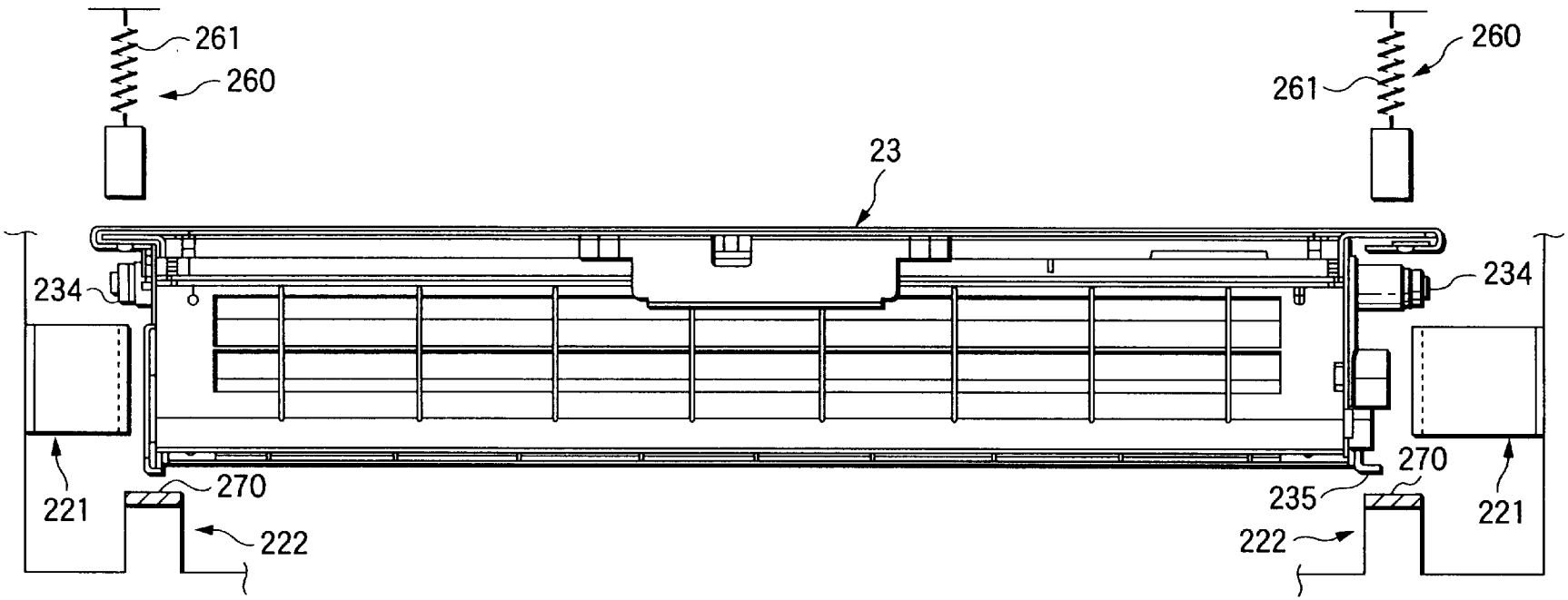
FIG. 17 is a left-hand side view showing how the belt unit that is used in the embodiment is positioned and fixed in the X and Y directions.

As shown in FIGS. 15–17, in the above X and Y direction positioning method for the belt unit 23, the belt unit 23 is positioned at four positions in total, that is, at two positions with respect to the two-direction (X and Y directions) positioning portions 221 and at two positions with respect to the one-direction (Y direction) positioning portions 222. However, for example, if the belt unit 23 is pressed against and fixed to the one-direction (Y direction) positioning portions 222 earlier than with respect to the two-direction (X and Y directions) positioning portions 221, the belt unit 23 is pressed against and fixed to the one-direction (Y direction) positioning portions 222 in the X direction in a state that it is not positioned correctly in the X direction. If the belt unit 23 is fixed to the two-direction (X and Y directions) positioning portions 221 in this state, there is fear that excessive constraint may occur in the X-direction positioning and the belt unit 23 may be deformed (twisted).

In particular, this embodiment employs the following technique to prevent the belt unit 23 from being distorted (twisted).

Figure 18:
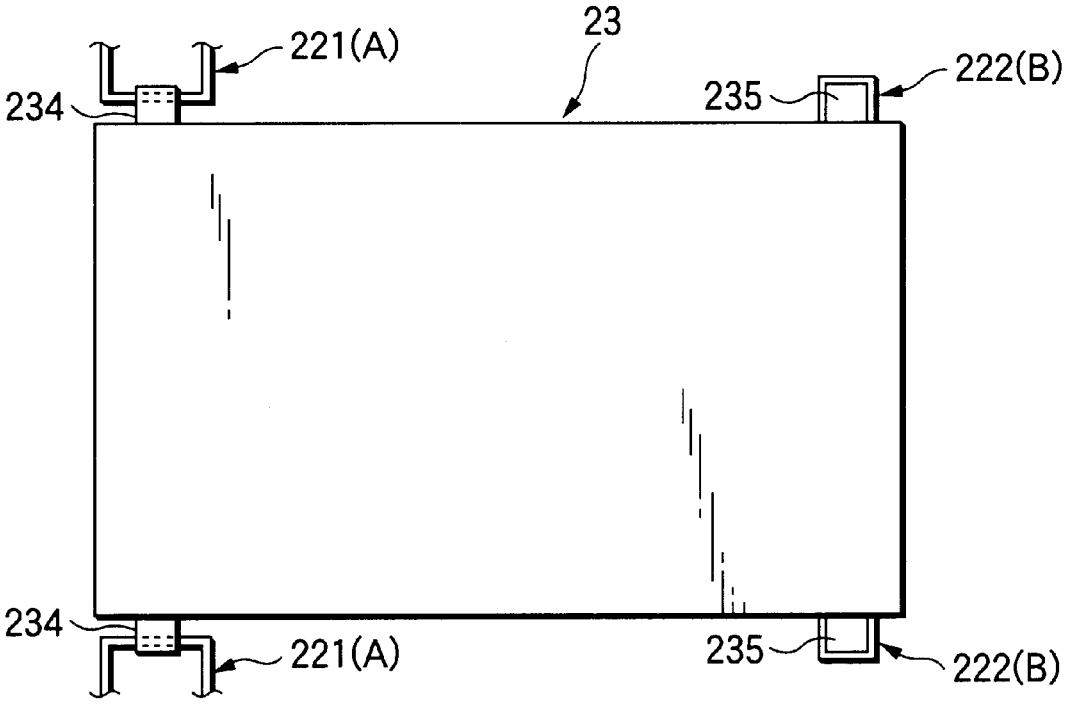
FIG. 18 is a schematic plan view showing how the belt unit that is used in the embodiment is positioned and fixed in the X and Y directions.

As shown in FIGS. 15–17 and a schematic diagrams of FIG. 18, first the positioning bosses 234 are pressed against and fixed to the two-direction (X and Y directions) positioning portions 221 (A) and then the positioning legs 235 are pressed against and fixed to the one-direction (Y direction) positioning portions 222 (B).

In this method, at this stage, whereas the two-direction positioning portions 221 (A) prohibit movement of the belt unit 23 in the X direction (belt running direction) and the Y direction (height direction) at the one end, movement of the belt unit 23 is not prohibited in the X and Y directions at the other end. Thereafter, the one-direction positioning portions 222 (B) prohibit movement of the belt unit 23 in the Y direction at the other end. At this time, the Y-direction constraining at the other end merely causes the belt unit 23 to make a follower movement in the X direction at the other end with the two-direction positioning portions 221 (A) as references.

Therefore, in the method in which priority is given to the positioning with respect to the two-direction positioning portions 221 (A), no excessive load acts on the positioning portions 221 and 222 for the belt unit 23 and there is almost no fear that the belt unit 23 may be deformed (twisted) during its positioning and fixing.

Another technique is such that the pressing force FA for fixing each positioning boss 234 to the associated two-direction positioning portion 221 (A) is set stronger than the pressing force FB for fixing each positioning leg 235 to the associated one-direction positioning portion (B).

To satisfy the condition FA>FB, selection may be made as appropriate from various methods, examples of which are setting a difference between the pressing forces of the pressing springs 261 of the belt unit fixing function portion 260, setting a difference between the weights of the portions of the belt unit 23 corresponding to the positioning portions 221 and the portions of the belt unit 23 corresponding to the positioning portions 222, and a combination of the two methods.

By setting a difference between the pressing forces FA and FB, the frictional resistance between each one-direction positioning portion 222 (B) and the associated positioning leg 235 is made weaker than the frictional resistance on the two-direction positioning portion 222(A) side, whereby the frictional sliding of the positioning legs 235 with respect to the one-direction positioning portions 222 (B) is facilitated and hence the belt unit 23 can be prevented from being deformed (twisted).

Still another technique is such that a slide-assisting member (e.g., POM) 270 having a small friction coefficient is provided on the surface of each one-direction positioning portion 222 (B) to reduce the sliding resistance between each one-directional positioning portion 222 (B) and the associated positioning leg 235. Although in this example the slide-assisting members 270 are provided on the one-direction positioning portion 222 (B) side, they may be provided on the positioning leg 235 side or on both sides.

According to this technique, the frictional resistance between each one-direction positioning portion 222 (B) and the associated positioning leg 235 is made weaker than the frictional resistance on the two-direction positioning portion 222(A) side, whereby the frictional sliding of the positioning legs 235 with respect to the one-direction positioning portions 222 (B) is facilitated and hence the belt unit 23 can be prevented from being deformed (twisted).

A further technique is such that each positioning boss 234 to engage the associated two-direction positioning portion 221 (A) is provided with a slide-assisting member (not shown) such as a bearing. Although in this example the positioning bosses 234 are provided with the slide-assisting members, the positioning grooves of the two-direction positioning portions 221 (A) may be provided with slide-assisting members or both of the positioning bosses 234 and the positioning grooves of the two-direction positioning portions 221 (A) may be provided with slide-assisting members.

According to this technique, the sliding resistance that occurs when each positioning boss 234 is moved in the height direction with respect to the associated two-direction positioning portion 221 (A) is reduced, whereby the pressing force FA of the belt unit fixing function portion 260 that acts on each two-direction positioning portion 221 (A) can be made stronger than the pressing force FB that acts on each one-direction positioning portion 222 (B).

As a result, the frictional resistance between each one-direction positioning portion 222 (B) and the associated positioning leg 235 is made weaker than the frictional resistance on the two-direction positioning portion 222(A) side, whereby the frictional sliding of the positioning legs 235 with respect to the one-direction positioning portions 222 (B) is facilitated and hence the belt unit 23 can be prevented from being deformed (twisted).

[3] Subunit releasing/fixing mechanism

[3-1] Specific example 1

FIGS. 19 to 21A–21C show a specific example 1 of the subunit releasing/fixing mechanism 500 that is used in the embodiment.

As shown in FIGS. 19 to 21A–21C, the subunit releasing/fixing mechanism 500 is configured as follows. A unit support frame 501 that can be elevated and lowered is provided on the inside surface of each of the pair of main frames 202 and 203 (the main frame 202 is not shown in FIGS. 19 and 20) of the main body frame 200. Each unit support frame 501 is supported with intervention of link mechanisms 502 and 503 so as to be able to ascend and descend. Driving rods 504 that advance or retreat in link with a rotary manipulation on a manipulation lever 505 are connected to the respective link mechanisms 502 and 503.

In this example, as for the unit support frames 501, the top portions of a pair of side frames 511 are connected to each other by a connection frame 512. Each side frame 511 has such a shape as is obtained by removing a bottom-center portion of a rectangular frame.

The top straight portion of each side frame 511 is formed with engagement hooks 513 and 514. Support pins 515 and 516 (in this example, the positioning boss 234 also serves as the support pin 515) that project from the associated side frame of the belt unit 23 are engaged with the respective engagement hooks 513 and 514 so as to be able to ascend and descend. On the other hand, each side frame 511 is formed, at bottom-front and bottom-rear positions, with engagement slits 517 that extend in the horizontal direction.

Figure 21A:
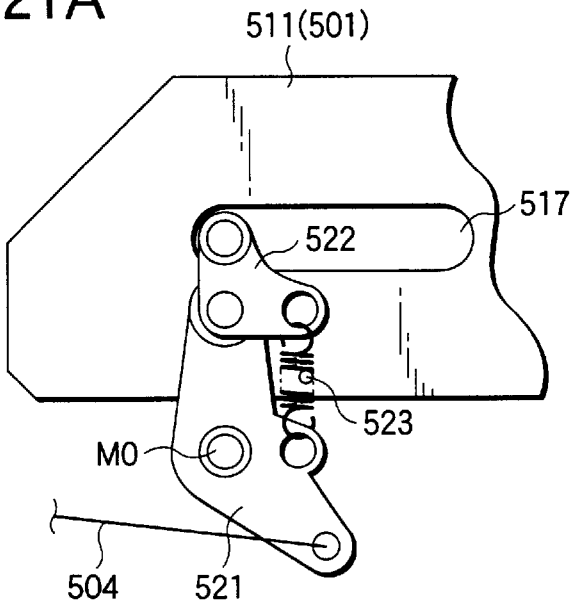
FIGS. 21A–21C show how part XVII, in FIG. 19, of the specific example 1 of the subunit releasing/fixing mechanism operates.
Figure 21B:
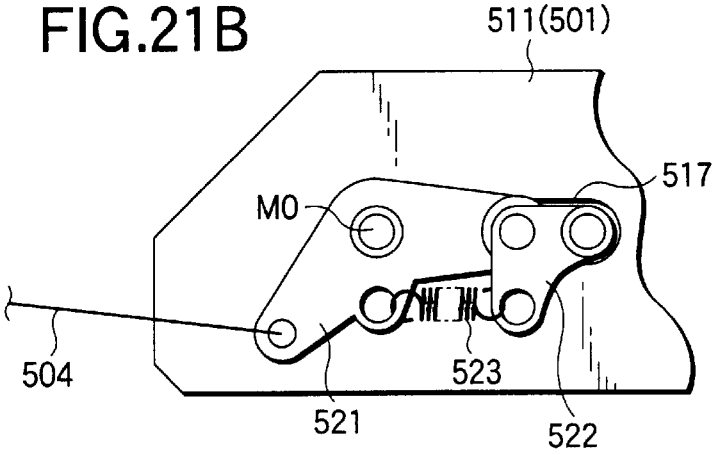
Figure 21C:
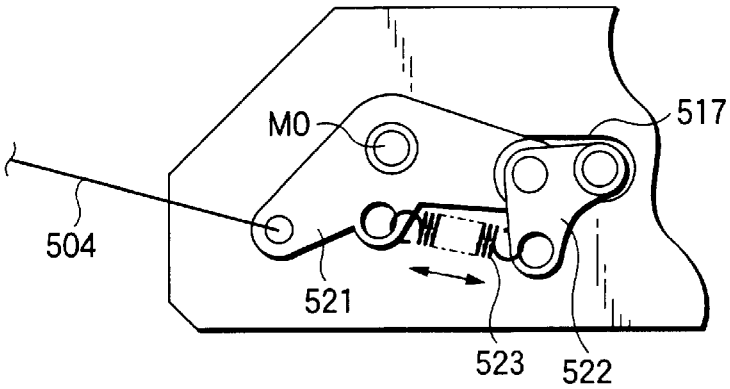

As shown particularly in FIGS. 21A–21C, the link mechanism 502 is composed of a link arm 521, a fixing arm 522, and a fixing spring 523. The link arm 521 is generally assumes a V shape having a large, obtuse angle and its approximately central portion is attached to the main body frame 200 via a shaft (the center of rotation is denoted by M0). The driving rod 504 is connected to one end portion of the link arm 521. The fixing arm 522 assumes a generally triangular shape whose first apex portion is rotatably attached to the other end portion of the link arm 521 via a shaft. A second apex portion of the fixing arm 522 is engaged rotatably and slidably with the engagement slit 517 of the unit support frame 501. The fixing spring 523 is connected to an inside bending portion of the link arm 521 and a third apex portion of the fixing arm 522.

The link mechanism 503 is the same as the link mechanism 502 except that they are mirror images of each other.

Figure 19:
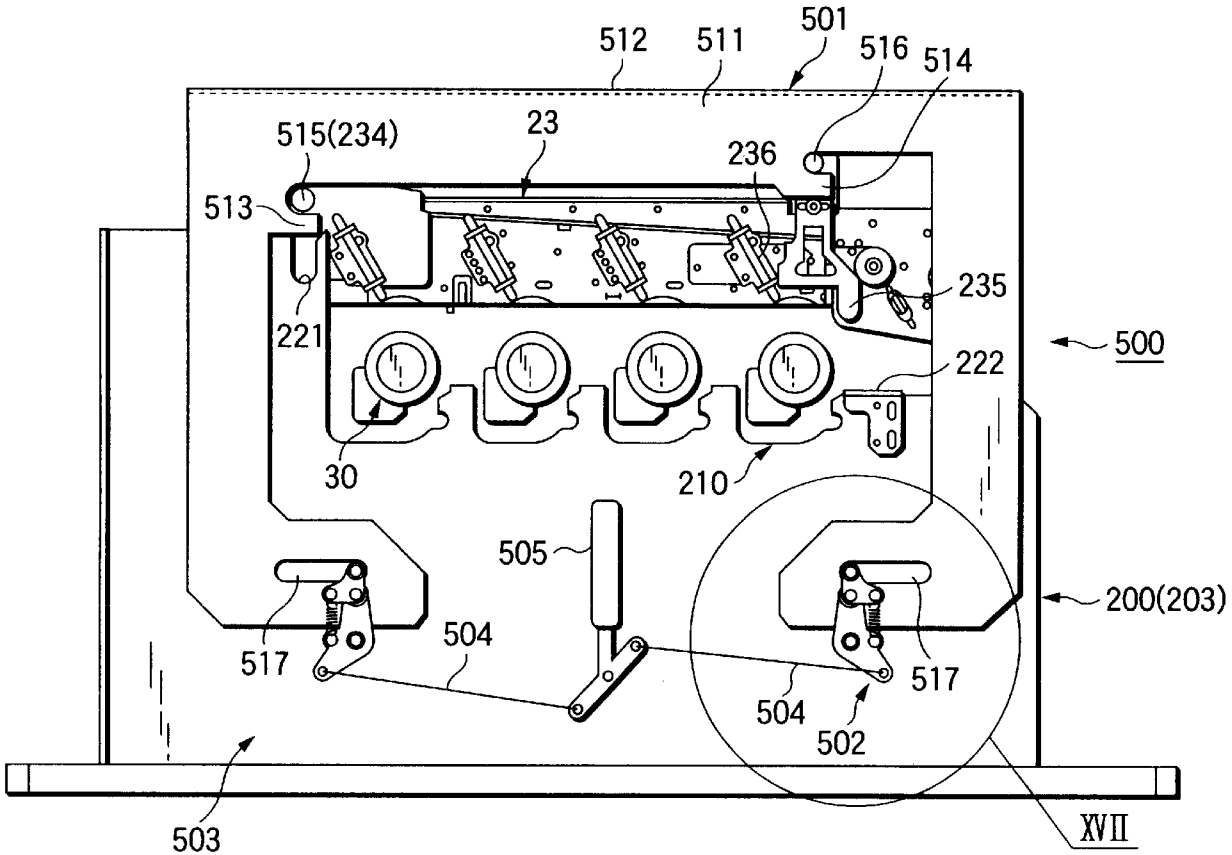
FIG. 19 shows a specific example 1 (released state) of a subunit releasing/fixing mechanism of the image forming apparatus according to the embodiment.

With the above subunit releasing/fixing mechanism 500, when the manipulation lever 505 is held so as to take an upright posture as shown, for example, in FIG. 19, as shown in FIG. 21A in the link mechanism 502, the fixing spring 523 pulls the link arm 521 and the fixing arm 522 and the link arm 521 and the fixing arm 522 are kept in upright postures. Therefore, the unit support frame 501 is held at the elevated position. Because the engagement hooks 513 and 514 are engaged with the respective support pins 515 and 516, the belt unit 23 is held at the elevated, releasing position that is higher than the position where the belt unit 23 is to be positioned.

Figure 20:
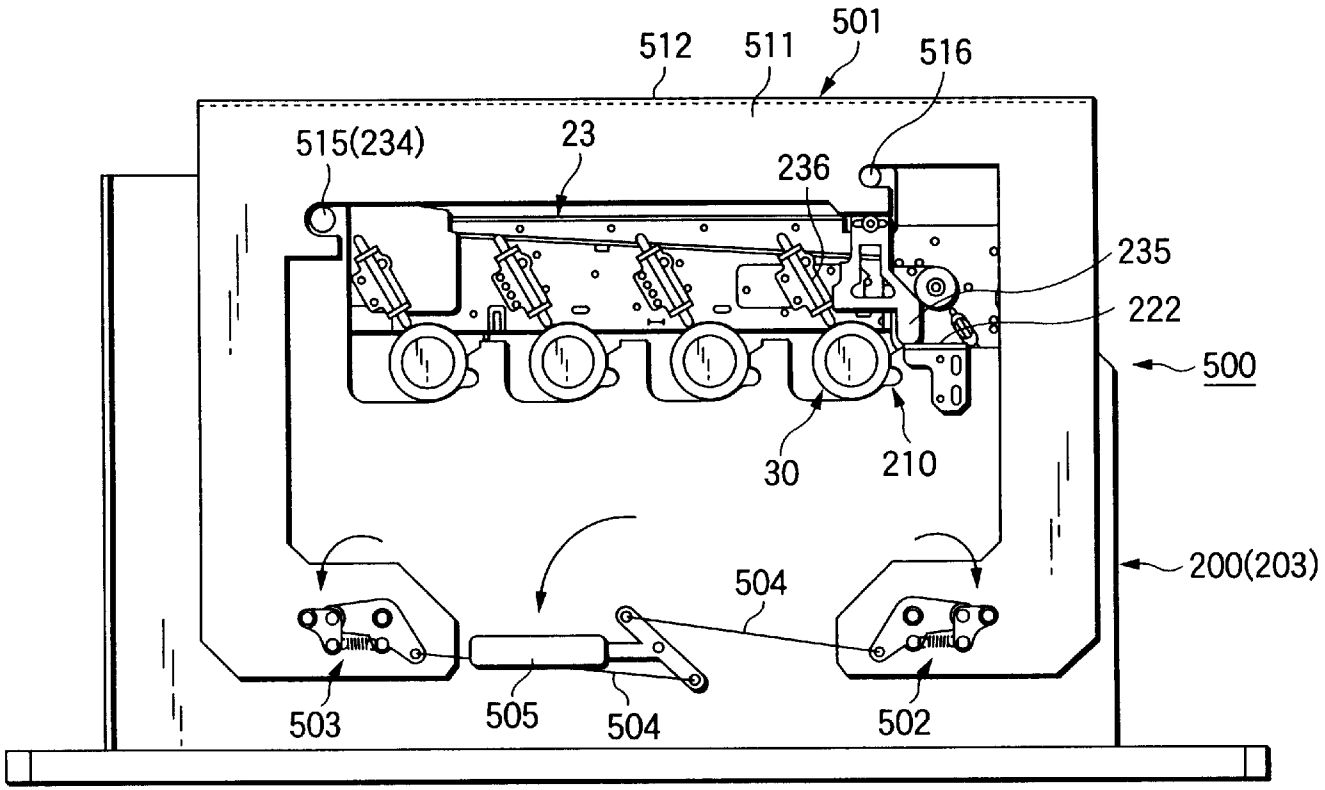
FIG. 20 shows a fixed state of the specific example 1 of the subunit releasing/fixing mechanism.

Then, when the manipulation lever 505 is rotated so as to take a horizontal posture as shown in FIG. 20, as shown in FIG. 21B, in the link mechanism 502, the link arm 521 is rotated about the point M0 as the driving rod 504 moves and the link arm 521 comes to take a posture that is close to the horizontal posture. Accordingly, the unit support frame 501 is pushed down while the fixing arm 522 is slid to the end position of the engagement slit 517.

When the belt unit 23 is positioned and fixed as the unit support frame 501 lowers, the descent of the unit support frame 501 is stopped.

As shown in FIG. 21C, in the link mechanism 502, with the fixing arm 522 located at the end position of the engagement slit 517, the link arm 521 is further rotated so as to take a posture that is even closer to the horizontal posture. The state of the fixing spring 523 is changed to an expanded state. In this state, the pulling force of the fixing spring 523 acts as force of pushing down the unit support frame 501, that is, as force of fixing the belt unit 23 that is positioned with respect to the positioning portions 221 and 222.

As shown in FIGS. 31A and 31B to FIGS. 33A and 33B, for example, the subunit releasing/fixing mechanism 500 of this example is further provided with link motion support mechanisms 530 for supporting the photoreceptor units 30 in link with a releasing/fixing operation on the belt unit 23.

Each link motion support mechanism 530 is configured as follows. The unit case 313 of each photoreceptor unit 30 is provided with an engagement guide 531 that extends in the axial direction of the photoreceptor unit 30. Connection members 532 extending in the vertical direction hang down from proper positions of the unit frame 233 of the belt unit 23. Each connection member 532 is formed with an engagement slit 533 that extends in the vertical direction, and provided with a long guide rail 534 that extends in the width direction of the belt unit 23 (corresponds to the axial direction of the photoreceptor unit 30) and into which the engagement guide 531 is to fit. The guide rail 534 is provided with an engagement pin 535 for supporting, which is slidably engaged with the engagement slit 533.

Figure 31A:
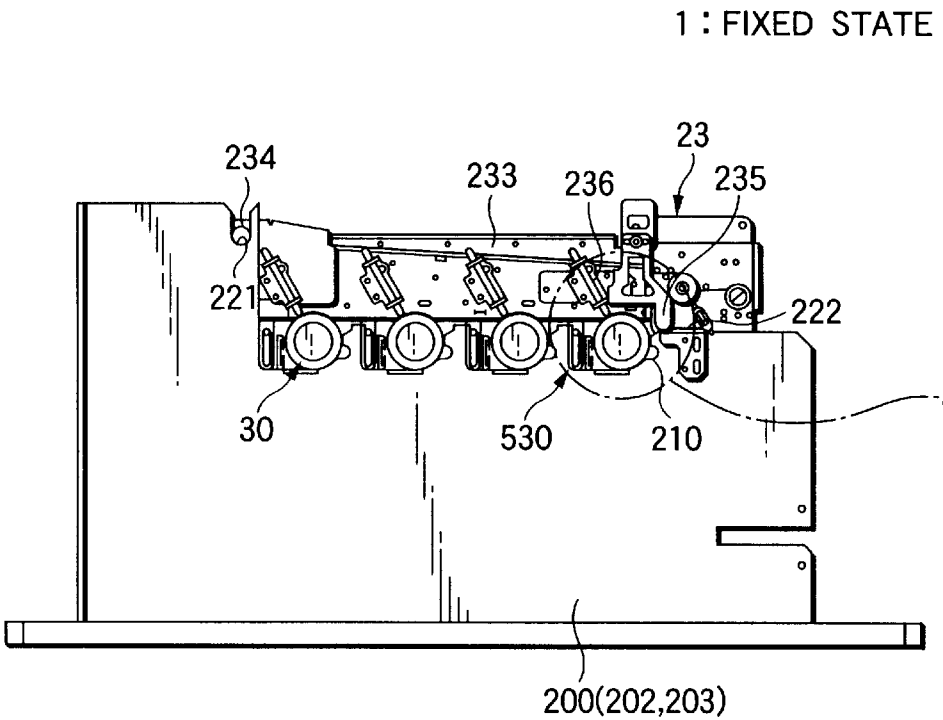
FIGS. 31A and 31B show exemplary link motion mechanisms (fixed state) that are used in the subunit releasing/fixing mechanism of the image forming apparatus according to the embodiment.
Figure 31B:
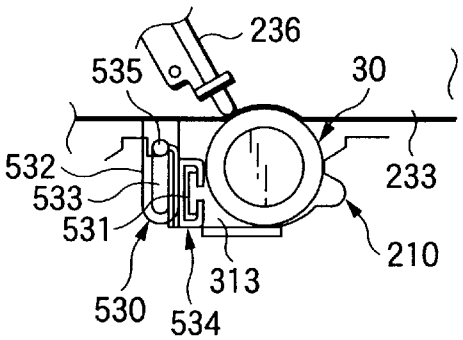

With the link motion support mechanisms 530 of this example, when the photoreceptor units 30 and the belt unit 23 are fixed to the main body frame 200, as shown in FIGS. 31A and 31B, the photoreceptor units 30 are positioned with respect to the positioning portions 210 and pressed and fixed by the pressing members 236 of the belt unit 23. On the other hand, the belt unit 23 is positioned with respect to the prescribed positioning portions 221 and 222 by the subunit releasing/fixing mechanism 500 and pressed and fixed by the fixing forces of the fixing springs 523 of the link mechanisms 502 and 503.

In this state, as shown in FIG. 20, the manipulation lever 505 of the subunit releasing/fixing mechanism 500 is at the fixing manipulation position (it takes a horizontal posture).

If in the above fixed state the manipulation lever 505 of the subunit releasing/fixing mechanism 500 is moved toward the releasing manipulation position (where it will take an upright posture) as shown in FIG. 19, the unit support frame 501 is elevated and the belt unit 23 is gradually elevated because the engagement hooks 513 and 514 are engaged with the respective support pins 515 and 516.

At this stage, the state that the photoreceptor units 30 are fixed by the pressing members 236 of the belt unit 23 is canceled.

Figure 32A:
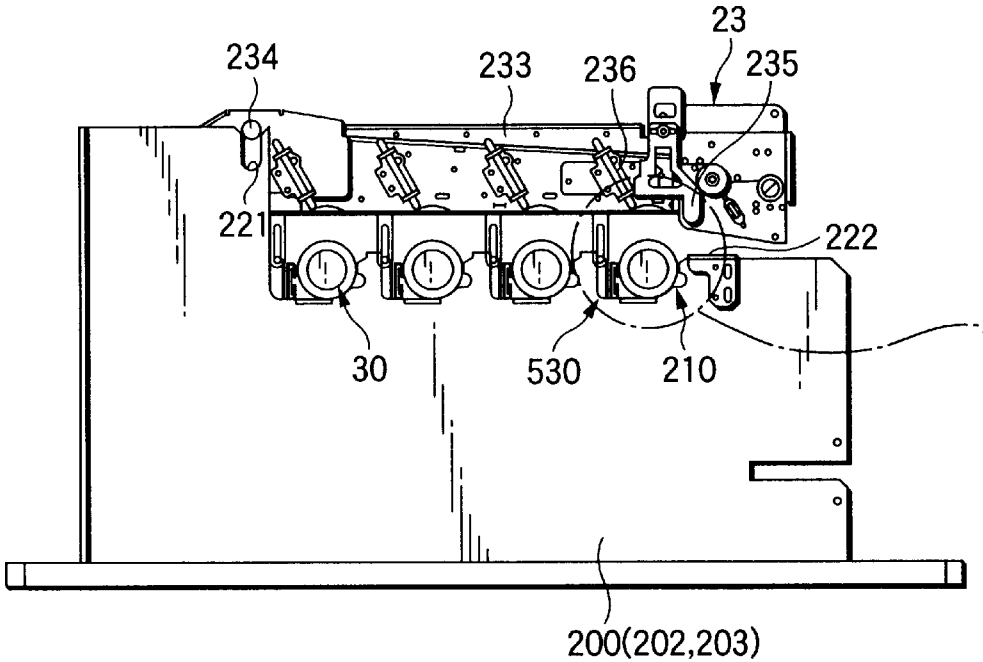
FIGS. 32A and 32B show the link motion mechanisms in a state that the belt unit is separated.
Figure 32B:
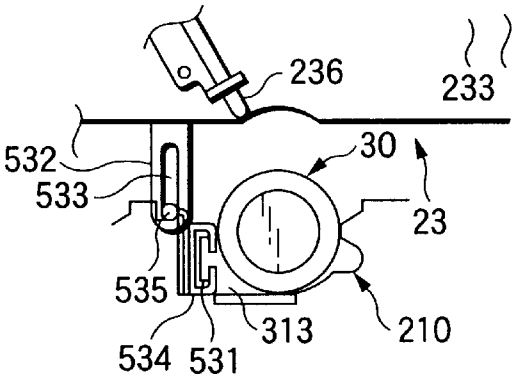
Figure 33A:
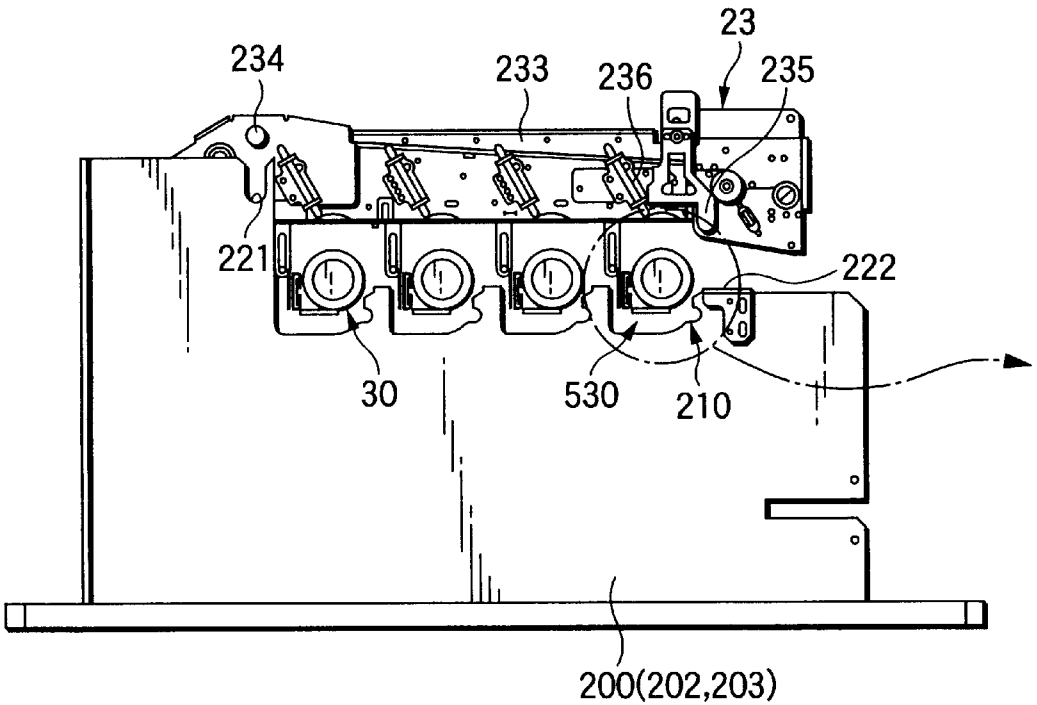
FIGS. 33A and 33B show the link motion mechanisms in a state that the belt unit and the photoreceptor units are separated (released).
Figure 33B:
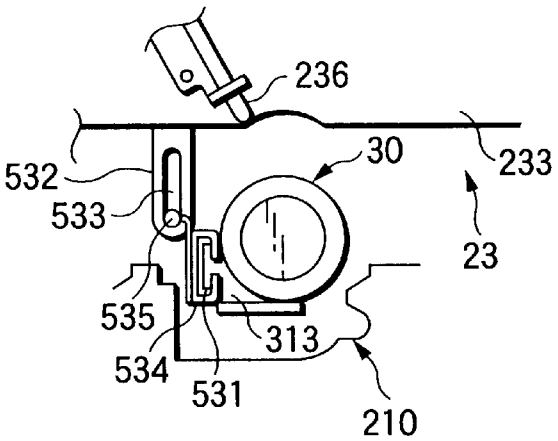

However, as shown in FIGS. 32A and 32B, in each link motion support mechanism 530, although the connection member 532 goes up as the belt unit 23 is elevated, only the engagement slit 533 of the connection member 532 moves upward and no upward moving force acts on the engagement pin 535 that is slidably engaged with the engagement slit 533. Therefore, even if the belt unit 23 is moved upward, the photoreceptor units 30 are kept positioned with respect to the positioning portions 210 as long as the movement length of the belt unit 23 is shorter than the length of the engagement slits 533.

After the belt unit 23 is further elevated to such an extent that the engagement pins 535 touch the bottom peripheries of the respective engagement slits 533, as the belt unit 23 is elevated the connection members 532 go up and the engagement pins 535 are thereby lifted as shown in FIGS. 32A and 32B and FIGS. 33A and 33B. The photoreceptor units 30 are elevated from the positioning portions 210 with intervention of the engagement pins 535.

When the belt unit 23 reaches the prescribed releasing position and is stopped there, the photoreceptor units 30 are also stopped at the prescribed releasing positions.

In this state, if the photoreceptor units 30 are to be replaced, the photoreceptor units 30 that are located at the releasing positions may be pulled out to the user's side in the axial direction, for example. Since the engagement guides 531 leave the respective guide rails 534 after sliding along the guide rails 534 as the photoreceptor units 30 are moved in the axial direction, the photoreceptor units 30 can be removed at this time point.

On the other hand, new photoreceptor units 30, for example, are set in the following manner. The manipulation lever 505 is moved to the releasing manipulation position (where it takes an upright posture) and held there as shown in FIG. 19, whereby the belt unit 23 is held at the releasing position with intervention of the unit support frame 501. Then, the engagement guides 531 of the new photoreceptor units 30 are engaged with the guide rails 534 that are provided in the respective connection members 532, whereby the photoreceptor units 30 are supported by the link motion support mechanisms 530.

In this state, the photoreceptor units 30 and the belt unit 23 are held at the releasing positions.

Then, when the manipulation lever 505 is moved toward the fixing manipulation position (where it will take a horizontal posture), the unit support frame 501 is lowered and the belt unit 23 and the photoreceptor units 30 that are supported by the belt unit 23 with intervention of the link motion support mechanisms 530 are also lowered.

At this time, although the link motion support mechanisms 530 merely support the respective photoreceptor units 30 with intervention of the connection members 532 in a hanged state, the photoreceptor units 30 lower due to their own weights. Before the belt unit 23 reaches the positioning members 221 and 222, the photoreceptor units 30 are positioned with respect to the positioning portions 210 by the pressing members 236 of the belt unit 23 while being prohibited from moving in the axial direction by the axial movement prohibiting portions 212.

Immediately before the manipulation lever 505 reaches the fixing manipulation position, the belt unit 23 continues to lower even after the photoreceptor units 30 are positioned. And the belt unit 23 finally reaches the positioning portions 221 and 222. As shown in FIGS. 31A and 31B and FIGS. 32A and 32B, the lowering of the belt unit 23 is enabled by the relative movement between the engagement slits 533 and the engagement pins 535.

As the belt unit 23 is lowered, it is positioned with respect to the positioning portions 221 and 222 while being prohibited from moving in the axial direction by the axial movement prohibiting portion 223.

Then, when the belt unit 23 reaches the positioning portions 221 and 222, the belt unit 23 is positioned with respect to and fixed to the positioning portions 221 and 222 by the fixing forces of the fixing springs 523 of the subunit releasing/fixing mechanism 500.

The photoreceptor units 30 are fixed to the positioning portions 210 by the pressing forces of the pressing members 236 of the belt unit 23.

With the above subunit releasing/fixing mechanism 500 (see FIGS. 19 to 21A–21C and FIGS. 31A and 31B to FIGS. 33A and 33B), the photoreceptor units 30 and the belt unit 23 are released according to the following releasing procedure (see FIGS. 5–7) by moving the manipulation lever 505 from the fixing manipulation position to the releasing manipulation position as shown in FIGS. 19 and 20:

(1) The fixing state of the belt unit 23 is canceled.

(2) The belt unit 23 is separated from the positioning portions 221 and 222.

(3) The fixing states of the photoreceptor units 30 are canceled.

(4) The photoreceptor units 30 are separated from the positioning portions 210.

On the other hand, the photoreceptor units 30 and the belt unit 23 are fixed according to the following fixing procedure (see FIGS. 5–7) by moving the manipulation lever 505 from the releasing manipulation position to the fixing manipulation position as shown in FIGS. 19 and 20.

(1) The belt unit 23 and the photoreceptor units 30 are held at the releasing positions.

(2) The photoreceptor units 30 are prohibited from axial movement (see FIGS. 8A and 8B to FIGS. 10A and 10B).

(3) The photoreceptor units 30 are positioned in the X and Y directions (see FIGS. 8A and 8B to FIGS. 10A and 10B).

(4) The belt unit 23 is prohibited from axial movement (see FIGS. 11A and 11B to FIGS. 14A and 14B).

(5) The belt unit 23 is positioned in the X and Y directions (see FIGS. 11A and 11B to FIGS. 14A and 14B).

(6) The belt unit 23 is fixed (see FIGS. 11A and 11B to FIGS. 14A and 14B).

(7) The photoreceptor units 30 are fixed (see FIGS. 8A and 8B to FIGS. 10A and 10B).

In the image forming apparatus that is provided with the above subunit releasing/fixing mechanism 500, the photoreceptor units 30 and the belt unit 23 can be moved to their releasing positions or positioning/fixing positions merely by manipulating one manipulation lever 505 in a prescribed direction.

Therefore, the belt unit 23 does not obstruct work of replacing the photoreceptor units 30 and new photoreceptor units 30 are set at their regular positions (positioning/fixing positions).

In particular, in this embodiment, since the unit 23 or the units 30 are prohibited from axial movement before they are positioned in the X and Y directions, the units 23 and 30 do not slide frictionally on the positioning portions 221 and 222 or 210 even if a mode of operation in which the unit 23 or the units 30 are prohibited from axial movement by the axial movement prohibiting mechanisms after they are positioned is employed (e.g., Japanese Patent Application Nos. Hei. 11-118606 and Hei. 10-305458).

Therefore, the photoreceptor units 30 and the belt unit 23 are positioned and fixed at their regular positions and misalignment is prevented effectively.

Since the complex releasing process or fixing process for the units 23 and 30 is effected by a single manipulation, the load of a user is reduced.

Further, since the subunit releasing/fixing mechanism 500 operates according to the releasing procedure or fixing procedure for the units 23 and 30 when a single manipulation is performed, there is no fear that an erroneous manipulation may damage or cause misalignment of the unit 23 or 30.

[3-2] Specific example 2

Figure 22:
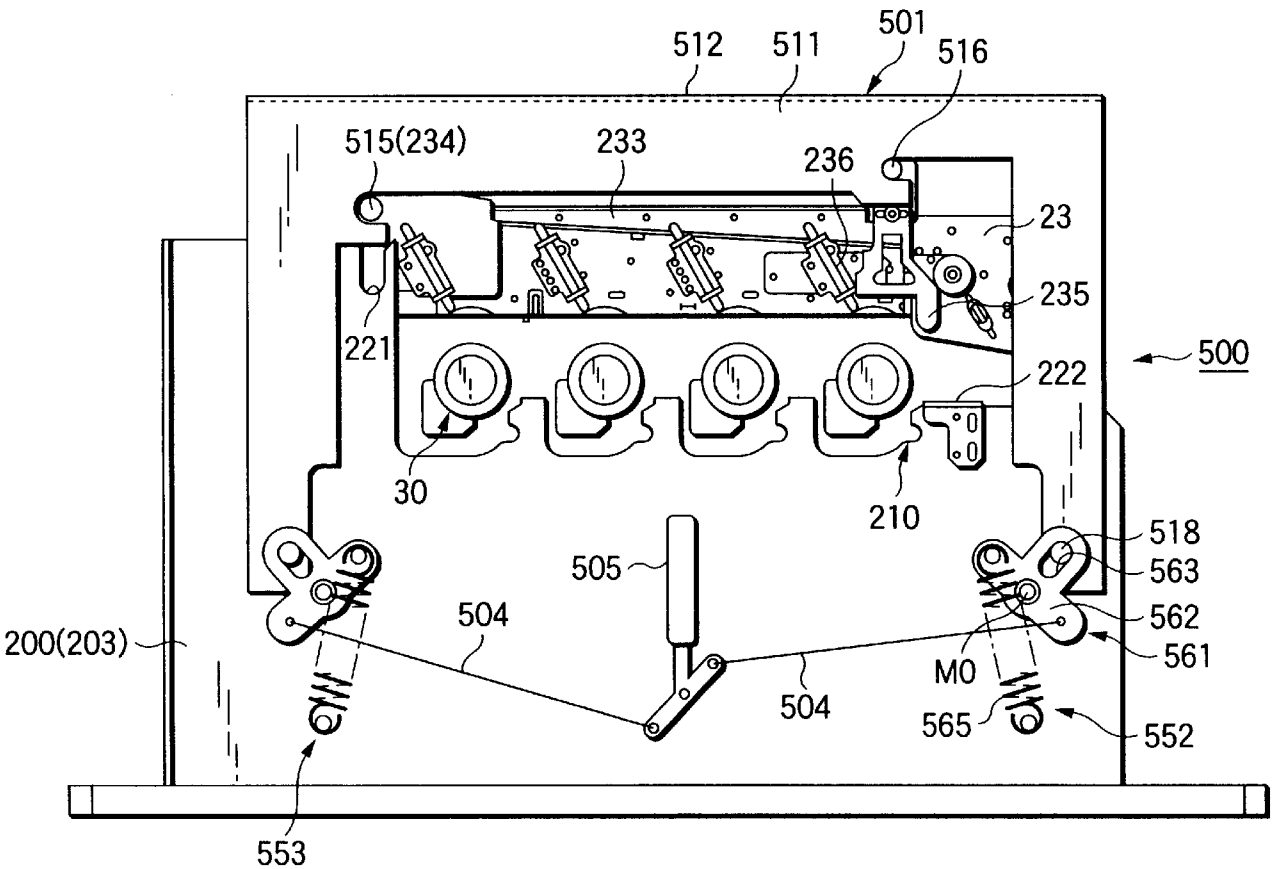
FIG. 22 shows a specific example 2 (released state) of the subunit releasing/fixing mechanism of the image forming apparatus according to the embodiment.
Figure 23:
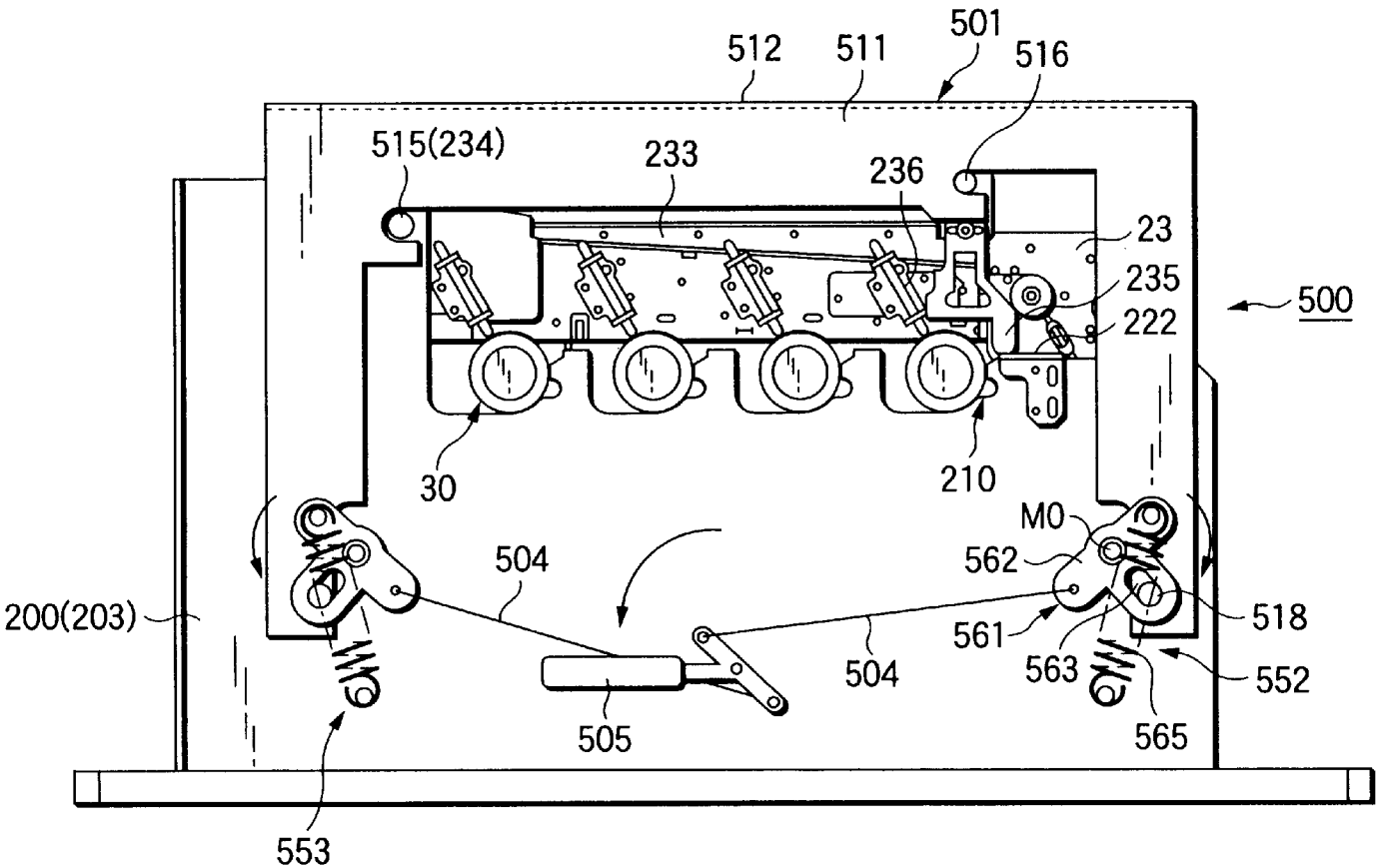
FIG. 23 shows a fixed state of the specific example 2 of the subunit releasing/fixing mechanism.

FIGS. 22 and 23 show a specific example 2 of the subunit releasing/fixing mechanism 500 that is used in the embodiment.

As shown in FIGS. 22 and 23, the subunit releasing/fixing mechanism 500 is configured as follows. A unit support frame 501 that can be elevated and lowered is provided on the inside surface of each of the pair of main frames 202 and 203 (the main frame 202 is not shown in FIGS. 22 and 23) of the main body frame 200. Each unit support frame 501 is supported with intervention of link mechanisms 552 and 553 so as to be able to ascend and descend. Driving rods 504 that advance or retreat in link with a rotary manipulation on a manipulation lever 505 are connected to the respective link mechanisms 552 and 553.

In this example, the unit support frame 501 is configured approximately in the same manner as in the specific example 1 (the components of the specific example 2 that are similar to the corresponding components of the specific example 1 are given the same reference symbols as the latter and will not be described in detail). The unit support frame 501 of this example is different than in the specific example 1 in that the side frame 511 has a channel shape having an opening at the bottom and engagement pins 518 project from bottom portions of the right and left straight portions.

As shown in FIGS. 22 and 23, the link mechanism 552 is composed of a link arm 561 and a fixing spring 565 that exerts prescribed urging force to the link arm 561.

The link arm 561 has an arm body 562 that is generally T-shaped. An approximately central portion of the horizontal bar of the T-shaped arm body 562 is attached to the main body frame 200 via a shaft (the center of rotation is denoted by M0). One end of the driving rod 504 is connected to one end portion of the horizontal bar of the T-shaped arm body 562. The leg of the T-shaped arm body 562 is formed with a long engagement hole 563 with which the engagement pin 518 of the unit support frame 501 is engaged.

On the other hand, one end of the fixing spring 565 is fixedly engaged with the main body frame 200. The other end of the fixing spring 565 is fixedly engaged with a portion of the horizontal bar of the T-shaped arm body 562 of the link arm 561 that is located on the side opposite to the engagement point of the driving rod 504.

The link mechanism 553 is approximately the same as the link mechanism 552 except that they are mirror images of each other.

Further, link motion support mechanisms 530 that are the same as in the specific example 1 (see FIGS. 31A and 31B to FIGS. 33A and 33B) are also provided in this example.

With the above subunit releasing/fixing mechanism 500, when the manipulation lever 505 is held at the releasing manipulation position (where it takes an upright posture) as shown in FIG. 22, for example, in the link mechanism 552 the urging force of the fixing spring 565 causes the leg of the T-shaped arm body 562 of the link arm 561 to extend obliquely with its tip located above. Therefore, the unit support frame 501 is held at the elevated position. Because the engagement hooks 513 and 514 are engaged with the respective support pins 515 and 516, the belt unit 23 is held at the elevated, releasing position that is higher than the position where the belt unit 23 is to be positioned.

On the other hand, when the manipulation lever 505 is rotated so as to take a horizontal posture as shown in FIG. 23, in the link mechanism 552 the link arm 561 is rotated about the center of rotation M0 as the driving rod 504 moves, whereby the leg of the T-shaped arm body 562 of the link arm 561 extends obliquely with its tip located below and the inclined fixing spring 565 urges downward the one end portion of the horizontal bar of the T-shaped arm body 562 of the link arm 561.

As the link arm 561 is rotated, the unit support frame 501 is lowered and the belt unit 23 is also lowered accordingly. At a time point when the belt unit 23 reaches the positioning portions 221 and 222, the urging force of the fixing spring 565 starts to act as fixing force for pressing the belt unit 23 downward with intervention of the unit support frame 501, as a result of which the belt unit 23 is positioned with respect to and fixed to the positioning portions 221 and 222 in a reliable manner.

Also in this example, since the link motion support mechanisms 530 operate, the photoreceptor units 30 are released or fixed together with the belt unit 23 according to a prescribed releasing procedure or fixing procedure in the same manner as in the specific example 1.

[3-3] Specific example 3

FIGS. 24 to 26A–26C show a specific example 3 of the subunit releasing/fixing mechanism 500 that is used in the embodiment.

As shown in FIGS. 24 to 26A–26C, the subunit releasing/fixing mechanism 500 is configured as follows. A unit support frame 501 that can be elevated and lowered is provided on the inside surface of each of the pair of main frames 202 and 203 (the main frame 202 is not shown in FIGS. 24 and 25) of the main body frame 200. Each unit support frame 501 is supported with intervention of link mechanisms 572 and 573 so as to be able to ascend and descend. A movement of a movable member 507 that advances or retreats in the horizontal direction in link with a rotary manipulation on a manipulation lever 506 is transmitted to the link mechanisms 572 and 573.

As in the cases of the specific examples 1 and 2, the subunit releasing/fixing mechanism 500 of this example is provided with the link motion support mechanisms 530 (see FIGS. 31A and 31B to FIGS. 33A and 33B).

In this example, the unit support frame 501 is configured approximately in the same manner as in the specific example 1 though the positions of the engagement slits 517 are somewhat different than in the specific example 1.

The movable member 507 is supported by the outside side surface of the main body frame 200 so as to be able to advance and retreat in the horizontal direction. The movable member 507 is advanced or retreated in accordance with a swing manipulation on the manipulation lever 506 between the releasing manipulation position (where it is inclined leftward) and the fixing manipulation position (where it is inclined rightward). Both end portions of the movable member 507 are formed with respective racks 508.

Figure 26A:
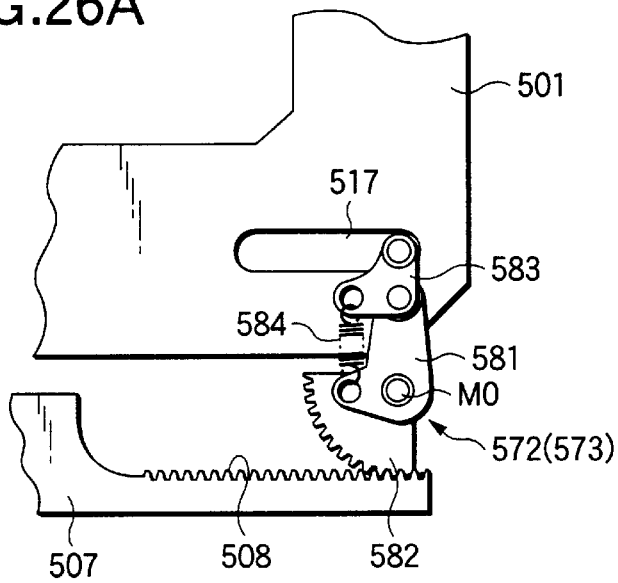
FIGS. 26A–26C show how part XXII, in FIG. 24, of the specific example 3 of the subunit releasing/fixing mechanism operates.
Figure 26B:
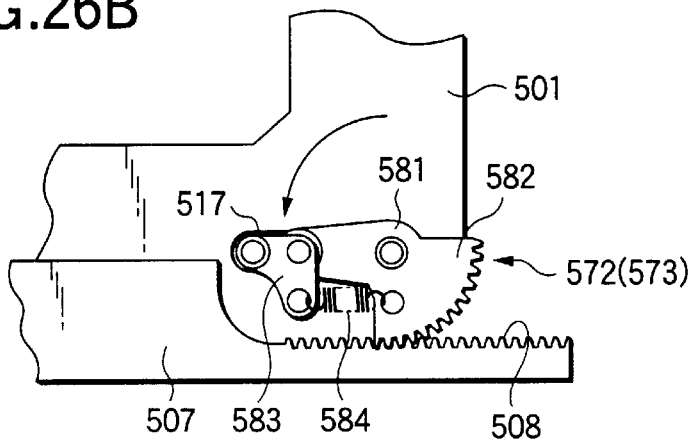
Figure 26C:
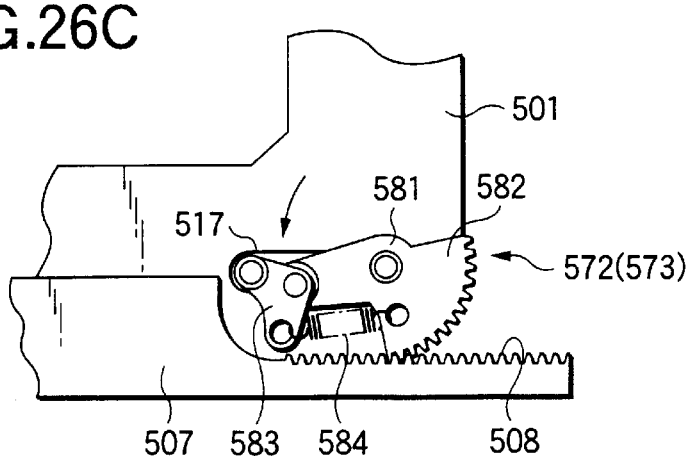

As shown particularly in FIGS. 26A–26C, the link mechanism 572 is composed of a gear link arm 581, a fixing arm 583, and a fixing spring 584. The gear link arm 581 is provided, at one end, a fan-shaped gear portion 582 that is in mesh with the rack 508 of the movable member 507. An approximately central portion of the gear link arm 581 is attached to the main body frame 200 via a shaft (the center of rotation is denoted by M0). The fixing arm 583 has a generally triangular shape. A first apex portion of the fixing arm 583 is rotatably attached, via a shaft, to a portion of the gear link arm 581 that is located on the side opposite to the side where the fan-shaped gear portion 582 is located. A second apex portion of the fixing arm 583 is engaged rotatably and slidably with the engagement slit 517 of the unit support frame 501. The fixing spring 584 is connected to a portion of the fan-shaped gear portion 582 of the gear link arm 581 and a third apex portion of the fixing arm 583.

The link mechanism 573 is approximately the same as the link mechanism 572.

Further, in this example, a lever movement prohibiting mechanism 590 for prohibiting movement of the manipulation lever 506 is provided.

The lever movement prohibiting mechanism 590 is configured as follows. A generally V-shaped restriction arm 591 is attached rotatably to the main body frame 200 (specifically, the main frame 203; see FIG. 3). One arm of the restriction arm 591 is formed with a U-shaped groove 592. A restriction spring 593 is provided between the tip portion of the other arm of the restriction arm 591 and the main body frame 200. An engagement pin 594 that is engaged with the U-shaped groove 592 projects from the movable member 507.

Figure 24:
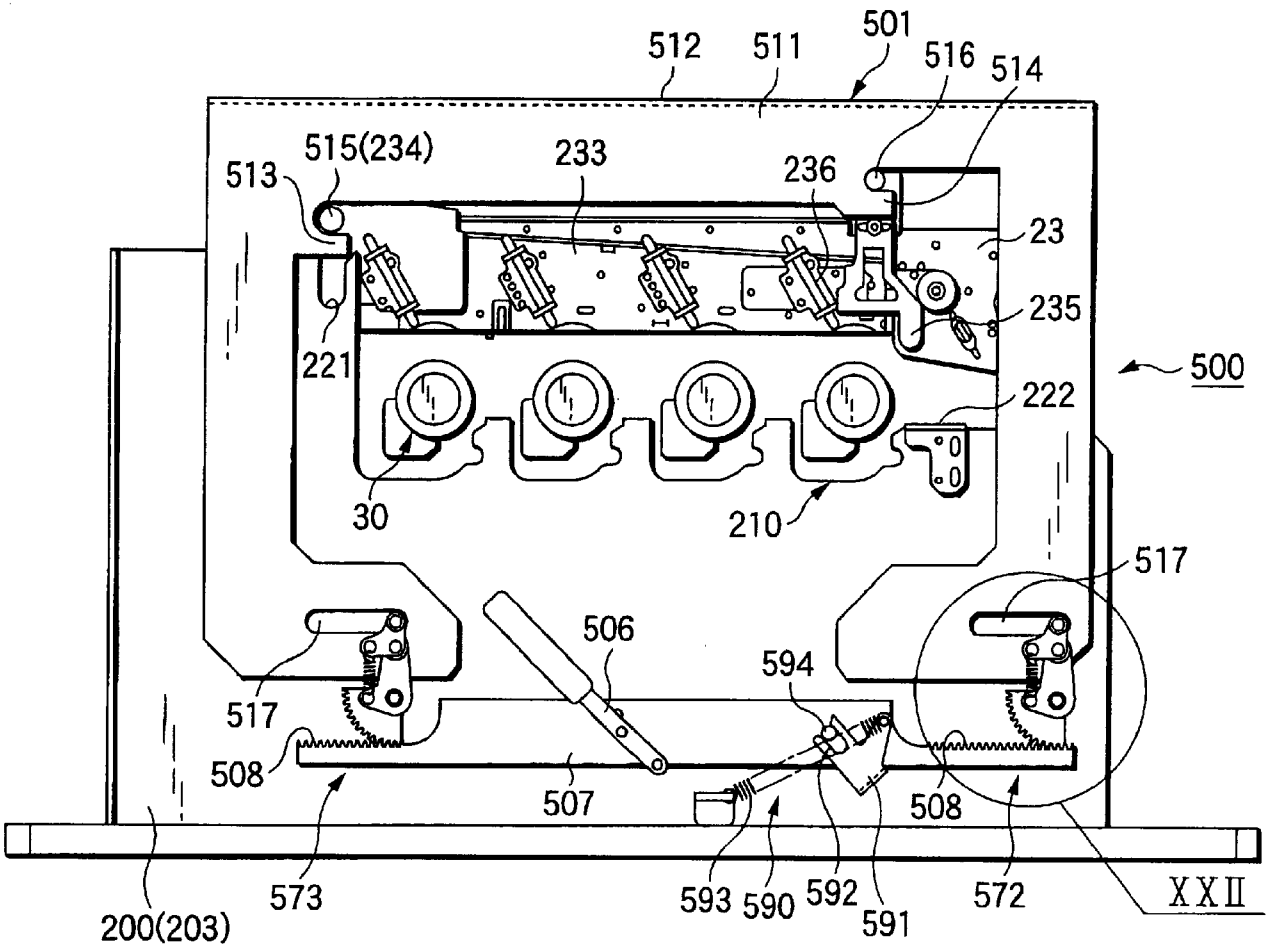
FIG. 24 shows a specific example 3 (released state) of a subunit releasing/fixing mechanism of the image forming apparatus according to the embodiment.

With the above sub-unit releasing/fixing mechanism 500, when the manipulation lever 506 is held at the releasing manipulation position (where it is inclined leftward) as shown in FIG. 24, for example, in the lever movement prohibiting mechanism 590 the opening of the V-shaped restriction arm 591 is located above and the restriction spring 593 urges the restriction arm 591 counterclockwise. However, since the engagement pin 594 is engaged with the U-shaped groove 592 of the restriction arm 591, rotation of the restriction arm 591 is prohibited and the manipulation lever 506 is constrained and held at the releasing manipulation position reliably.

In this state, since the movable member 507 is located at the prescribed position, as shown in FIG. 26A, in the link mechanisms 572 and 573 the relative position of the fan-shaped gear portion 582 that is in mesh with the rack 508 of the movable member 507 is determined uniquely and the gear link arm 581 is kept in an upright posture.

The gear link arms 581 cause, with intervention of the fixing arms 583, the unit support frame 501 to be held at the elevated position. Therefore, the gear link arms 581 cause the belt unit 23 to be held at the releasing position, and cause, with intervention of the link motion support mechanisms 530, the photoreceptor units 30 to be held at the releasing positions.

Figure 25:
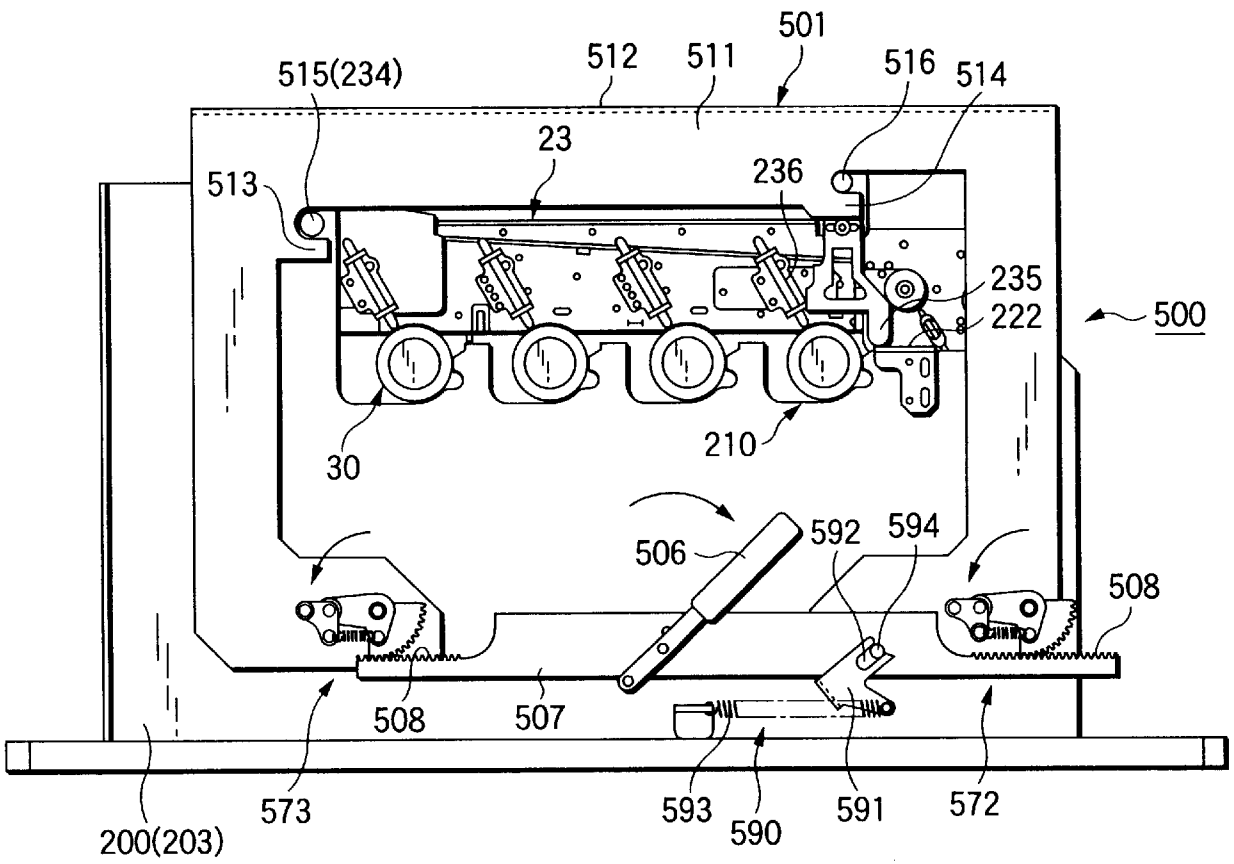
FIG. 25 shows a fixed state of the specific example 3 of the subunit releasing/fixing mechanism.

Then, when the manipulation lever 506 is moved toward the fixing manipulation position (where it will be inclined rightward) as shown in FIG. 25, the movable member 507 is moved rightward as the manipulation lever 506 swings.

As the movable member 507 is moved rightward in FIG. 25, in the lever movement prohibiting mechanism 590 the engagement pin 594 rotates the restriction arm 591 clockwise and the opening of the V-shaped restriction arm 591 is thereby located on the right side.

As a result, the restriction spring 593 goes over the center of rotation of the restriction arm 591 and comes to urge the restriction arm 591 clockwise. However, since the engagement pin 594 is engaged with the U-shaped groove 592 of the restriction arm 591, the restriction arm 591 is prohibited from rotation and the manipulation lever 506 is constrained and held at the fixing manipulation position reliably.

On the other hand, as the movable member 507 is moved rightward in FIG. 25, as shown in FIG. 26B, in the link mechanisms 572 and 573 the fan-shaped gear portions 582 that are in mesh with the respective racks 508 are moved and the gear link arms 581 are thereby inclined.

As a result, the gear link arms 581 lower the unit support frame 501 with intervention of the fixing arms 583. Therefore, the gear link arms 581 directly move the belt unit 23 from the releasing position to the positioning portions 221 and 222, and move the photoreceptor units 30 from the releasing positions to the positioning portions 210 with intervention of the link motion support mechanisms 530.

Then, when the racks 508 of the movable member 507 are further moved rightward as shown in FIG. 26C, the fan-shaped gear portions 582 are rotated further. Since the span between the gear link arm 581 and the fixing arm 583 is increased, the fixing spring 584 that is provided between the gear link arm 581 and the fixing arm 583 is expanded.

In this state, the belt unit 23 has reached the positioning portions 221 and 222 and the urging forces of the fixing springs 584 act as fixing forces for pushing the belt unit 23 downward via the unit support frame 501. Therefore, the belt unit 23 is positioned with respect to and fixed to the positioning portions 221 and 222 reliably.

Also in this example, since the link motion support mechanisms 530 operate, the photoreceptor units 30 are released or fixed together with the belt unit 23 according to a prescribed releasing procedure or fixing procedure in the same manner as in the specific examples 1 and 2.

[3-4] Specific example 4

FIG. 27 to FIGS. 30A and 30B show a specific example 4 of the subunit releasing/fixing mechanism 500 that is used in the embodiment.

As shown in FIGS. 27 to FIGS. 30A and 30B, the subunit releasing/fixing mechanism 500 is configured as follows. A unit support frame 501 that can be elevated and lowered is provided on the inside surface of each of the pair of main frames 202 and 203 (the main frame 202 is not shown in FIGS. 27 and 28) of the main body frame 200. Each unit support frame 501 is supported with intervention of link mechanisms 602 and 603 so as to be able to ascend and descend. A movement of a movable member 606 that advances or retreats in the horizontal direction in link with a rotary manipulation on a manipulation lever 604 is transmitted to the link mechanisms 602 and 603.

As in the cases of the specific examples 1–3, the subunit releasing/fixing mechanism 500 of this example is provided with the link motion support mechanisms 530 (see FIGS. 31A and 31B to FIGS. 33A and 33B).

In this example, the unit support frame 501 is configured approximately in the same manner as in the specific example 1.

The movable member 606 is supported by the outside side surface of the main body frame 200 so as to be able to advance and retreat in the horizontal direction. The movable member 606 is advanced or retreated in accordance with a swing manipulation on the manipulation lever 604 between the releasing manipulation position (where it takes a horizontal posture) and the fixing manipulation position (where it takes an upright posture).

More specifically, the manipulation lever 604 is connected to the central portion of a pinion gear 605 so as to be swingable. The pinion gear 605 is in mesh with a manipulation rack 607 of the movable member 606.

Further, the movable member 606 is formed with, in addition to the manipulation rack 607, link racks 608 and 609 that are involved in the respective link mechanisms 602 and 603.

Figure 29A:
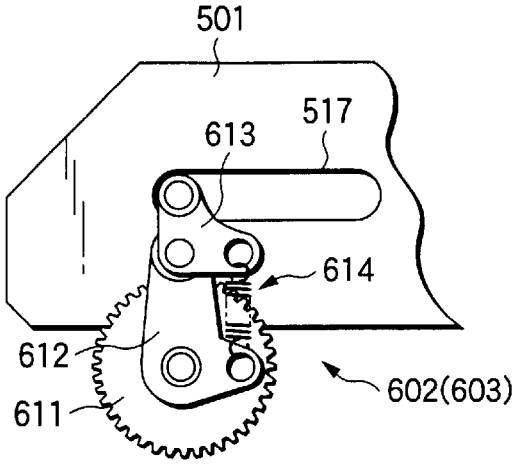
FIGS. 29A–29C show how part XXV, in FIG. 27, of the specific example 4 of the subunit releasing/fixing mechanism operates.
Figure 29B:
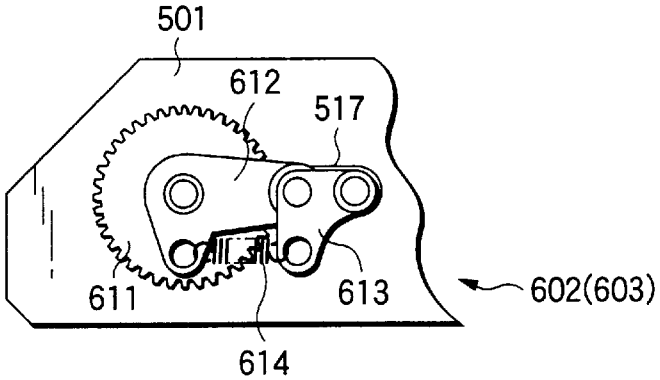
Figure 29C:
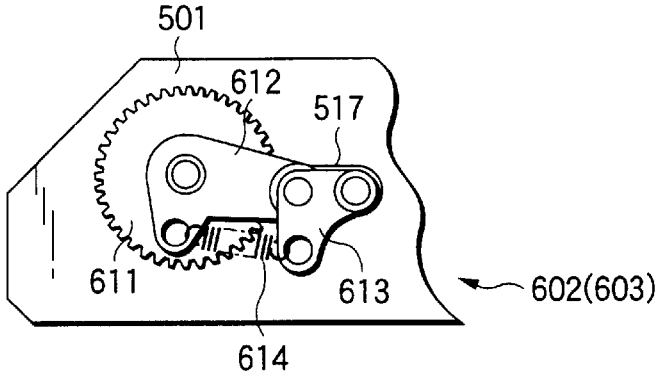

As shown particularly in FIGS. 29A–29C, the link mechanism 602 of this example is composed of a pinion gear 611, a link arm 612, a fixing arm 613, and a fixing spring 614. The pinion gear 611 is supported rotatably by the main body frame 200. The link arm 612 generally assumes a V shape having a large angle and its central portion is fixed to the central portion of the pinion gear 611. The fixing arm 613 has a generally triangular shape. A first apex portion of the triangular fixing arm 613 is attached rotatably to one end portion of the link arm 612 via a shaft. A second apex portion of the fixing arm 613 is engaged rotatably and slidably with an engagement slit 517 of the unit support frame 501. The fixing spring 614 is connected to the other end portion of the link arm 612 and a third apex portion of the fixing arm 613.

The link mechanism 603 is the same as the link mechanism 602 except that they are mirror images of each other.

Further, in this example, the subunit releasing/fixing mechanism 500 is provided with a fixing force increasing mechanism 620 for increasing the fixing forces for the belt unit 23.

The fixing force increasing mechanism 620 is configured as follows. As shown particularly in FIGS. 30A and 30B, a fixing force increasing arm 621 is attached rotatably to the main frame (not shown) of the main body frame 200. The fixing force increasing arm 621 is formed with a U-shaped groove 623 and a rotation stopping projection 622 whose rotation stopping function is exercised when it contacts the base frame 201 of the main body frame 200. On the other hand, an engagement pin 624 that is to engage the U-shaped groove 623 projects from the movable member 606. A tension spring 625 is provided between the main frame (not shown) of the main body frame 200 and a portion of the fixing force increasing arm 621 that is located on the side opposite to the rotation stopping projection 622.

Figure 27:
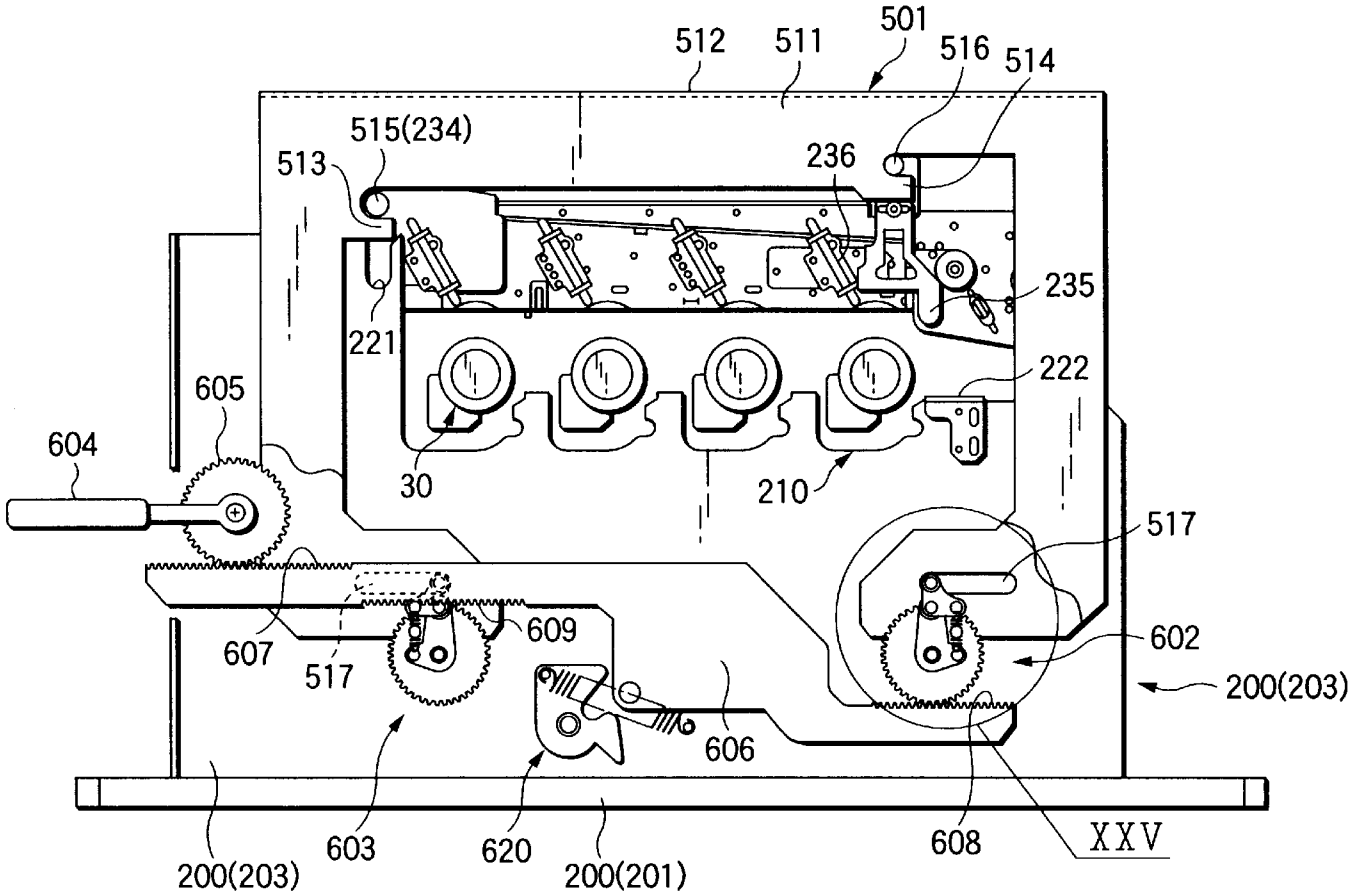
FIG. 27 shows a specific example 4 (released state) of a subunit releasing/fixing mechanism of the image forming apparatus according to the embodiment.

With the above subunit releasing/fixing mechanism 500, when the manipulation lever 604 is held at the releasing manipulation position (where it takes a horizontal posture) as shown in FIG. 27, for example, the movable member 606 is located at the prescribed position. Therefore, as shown in FIGS. 29A, in the link mechanisms 602 and 603 the relative positions of the pinion gears 611 that are in mesh with the respective link racks 608 and 609 of the movable member 606 are determined uniquely and the link arms 612 that are connected to the respective pinion gears 611 are kept in an upright posture.

The link arms 612 cause, with intervention of the fixing arms 613, the unit support frame 501 to be held at the elevated position. Therefore, the link arms 612 cause the belt unit 23 to be held at the releasing position, and cause, with intervention of the link motion support mechanisms 530, the photoreceptor units 30 to be held at the releasing positions.

Figure 28:
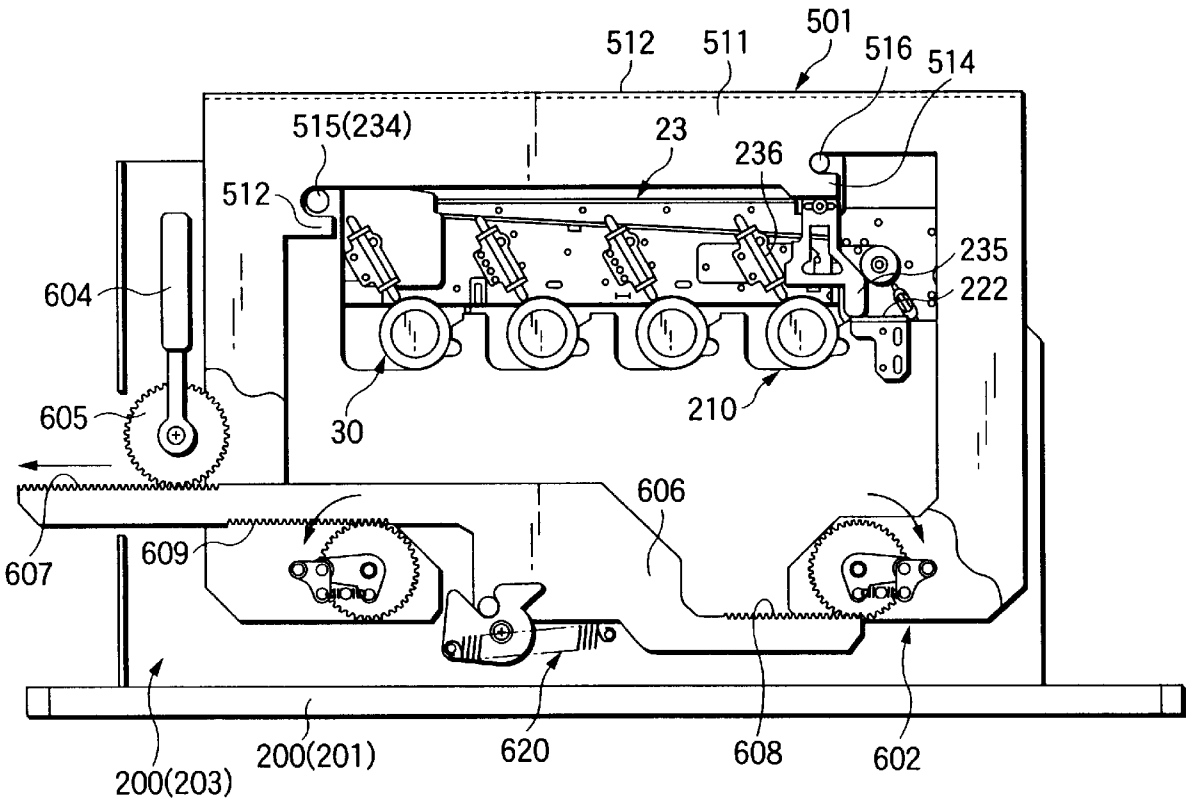
FIG. 28 shows a fixed state of the specific example 4 of the subunit releasing/fixing mechanism.

Then, when the manipulation lever 604 is moved to the fixing manipulation position (where it takes an upright posture) as shown in FIG. 28, as the manipulation lever 604 swings the pinion gear 605 is rotated meshing with the manipulation rack 607 and the movable member 606 is moved leftward in FIG. 28.

As shown in FIG. 29B, in the link mechanisms 602 and 603, the pinion gears 611 are rotated in the directions indicated by arrows in FIG. 28 meshing with the respective link racks 608 and 609 of the movable member 606 and the link arms 612 are thereby inclined.

As a result, the link arms 612 lower the unit support frame 501 with intervention of the fixing arms 613. Therefore, the gear link arms 612 directly move the belt unit 23 from the releasing position to the positioning portions 221 and 222, and move the photoreceptor units 30 from the releasing positions to the positioning portions 210 with intervention of the link motion support mechanisms 530.

Then, when the link racks 608 and 609 of the movable member 606 are further moved leftward as shown in FIG. 29C, the pinion gears 611 rotated further. Since the span between the link arm 612 and the fixing arm 613 is increased, the fixing spring 614 that is provided between the link arm 612 and the fixing arm 613 is expanded.

In this state, the belt unit 23 has reached the positioning portions 221 and 222 and the urging forces of the fixing springs 614 act as fixing forces for pushing the belt unit 23 downward via the unit support frame 501. Therefore, the belt unit 23 is positioned with respect to and fixed to the positioning portions 221 and 222 reliably.

Figure 30A:
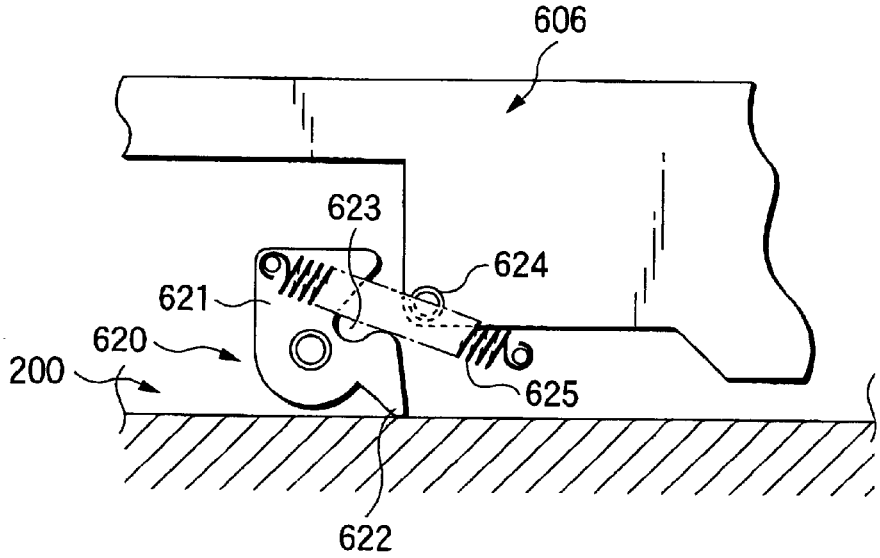
FIGS. 30A and 30B show how a fixing force increasing mechanism that is used in the specific example 4 operates.
Figure 30B:
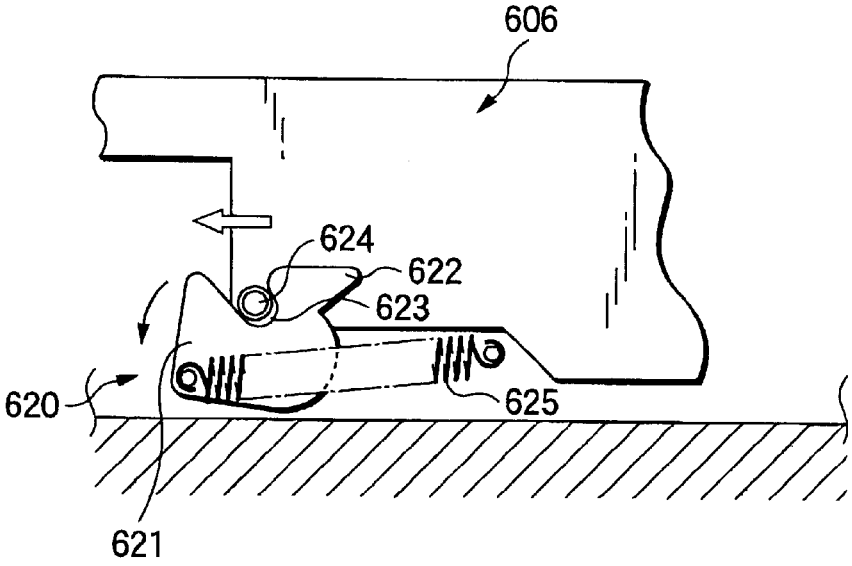

In particular, in this example, since the fixing force increasing mechanism 620 as shown in FIGS. 30A and 30B is provided, stronger fixing forces for fixing the belt unit 23 can be secured.

More specifically, when the manipulation lever 604 is moved to the fixing manipulation position (where it takes an upright posture), the movable member 606 is moved leftward in FIGS. 30A and 30B. The engagement pin 624 that is formed on the movable member 606 contacts the U-shaped groove 623 and rotates the fixing force increasing arm 621 counterclockwise as shown in FIG. 30B. The engagement pin 624 of the movable member 606 engages the U-shaped groove 623 of the fixing force increasing arm 621.

As a result, as shown in FIG. 30B, the tension spring 625 is moved downward so as to be located below the rotation axis of the fixing force increasing arm 621 and pulls the fixing force increasing arm 621 in such a direction that it is rotated counterclockwise.

In this state, since the U-shaped groove 623 of the fixing force increasing arm 621 prohibits movement of the engagement pin 624, the movable member 606 cannot make a play movement in its advancement/retreat direction and the link arms 612 of the link mechanisms 602 and 603 are fixedly held accordingly. Therefore, the fixing forces of the fixing springs 614 are transmitted to the belt unit 23 reliably.

Also in this example, since the link motion support mechanisms 530 operate, the photoreceptor units 30 are released or fixed together with the belt unit 23 according to a prescribed releasing procedure or fixing procedure in the same manner as in the specific examples 1 and 2.

Each of the above-described specific examples 1–4 of the subunit releasing/fixing mechanism 500 is provided with the link motion support mechanisms 530. Therefore, a single manipulation enables both of the belt unit 23 and the photoreceptor units 30 to be released or fixed in link with each other. However, the invention is not limited to such a case. A subunit releasing/fixing mechanism may be provided for each of the unit 23 and the units 30. Another configuration is possible in which the link motion support mechanisms 530 are not provided and the releasing/fixing operation using the subunit releasing/fixing mechanism 500 is performed only on the belt unit 23 that obstructs an operation of replacing the photoreceptor units 30.

As described above, according to one aspect of the invention, in an image forming apparatus in which plural subunits have a positional relationship that at least one of the subunits is located at such a position as to obstruct an operation of replacing another, positioning portions for the respective subunits are provided at regular positions of a main body frame and at least an outside subunit is moved from a positioning and fixing position to a prescribed releasing position by a subunit releasing mechanism. Therefore, work of removing an inside subunit can be performed without being obstructed by the outside subunit. Further, during work of replacing the inside subunit, the relative positional relationship between the outside subunit and the positioning and fixing position can be maintained. This makes it possible to prevent reliably occurrence of a positional deviation when the outside subunit is re-set.

According to another aspect of the invention, in an image forming apparatus in which plural subunits have a positional relationship that at least one of the subunits is located at such a position as to obstruct an operation of replacing another, positioning portions for the respective subunits are provided at regular positions of a main body frame and at least an outside subunit is held at a prescribed releasing position and moved from the prescribed releasing position to a prescribed, positioning and fixing position by a subunit fixing mechanism. Therefore, work of attaching the inside subunit can be performed without being obstructed by the outside subunit. Further, the subunits can easily be re-set at the positioning and fixing positions.

According to still another aspect of the invention, a positioning portion that positions a subunit is provided on the main body frame and the positioning portion comprises an axial movement prohibiting portion that prohibits in advance axial movement of the subunit before the subunit is positioned. Therefore, at the time of replacing the subunit, the subunit can be positioned with respect to the main body frame in a state that it is prohibited from axial movement. This eliminates fear that frictional sliding may occur between the main body frame and the subunit when axial movement of the subunit is prohibited by an axial movement prohibiting mechanism after the positioning.

This simplifies positioning work that is performed in replacing the subunit. Further, a registration error can effectively be prevented due to a positional deviation of the subunit in the axial direction and the subunit positioning accuracy can be made very stable. In addition, the subunit can effectively be prevented from being damaged by frictional sliding between the main body frame and the subunit.

According to a further aspect of the invention, positioning portions with respect to which a subunit is to be positioned are provided on the main body frame and the positioning portions include a two-direction positioning portion that prohibits movement of the subunit in a height direction and a horizontal direction and a one-direction positioning portion that prohibits movement of the subunit only in the height direction. The subunit is positioned preferentially with respect to the two-direction positioning portion over the one-direction positioning portion. Therefore, the one-direction positioning portion can effectively absorb a positioning error in the horizontal direction. This makes it possible to keep high subunit positioning performance while effectively preventing the subunit from being deformed (twisted).

Therefore, the invention can improve the workability of subunit replacement work and position a subunit at a regular position easily and correctly.

The entire disclosure of Japanese Patent Application No. 2000-347342 filed on Nov. 14, 2000 including specification, claims, drawings and abstract is incorporated herein by reference in its entirety.

What is claimed is:

1. A subunit attaching structure of an image forming apparatus in which plural subunits for image formation are attached to a main body frame in a detachable manner with a positional relationship that at least one of the subunits is located at such a position as to obstruct an operation of replacing another, comprising:

positioning portions that are provided on the main body frame and position the respective subunits; and a subunit releasing mechanism that is used in releasing at least part of the subunits from a state that they are positioned with respect to and fixed to the associated positioning portion, and that moves at least an outside subunit that obstructs an operation of replacing an inside subunit from a positioning and fixing position to a prescribed releasing position, wherein the inside subunit is a unit including a photoreceptor and the outside subunit is an intermediate transfer member or a sheet transport belt.

2. The subunit attaching structure according to claim 1, wherein the subunit releasing mechanism is used in releasing each of the subunits from a state that it is positioned with respect to and fixed to the associated positioning portion, and moves each of the subunits from a positioning and fixing position to a prescribed releasing position.

3. The subunit attaching structure according to claim 1, wherein the subunit releasing mechanism operates according to a prescribed releasing procedure.

4. A subunit removing method of an image forming apparatus in which plural subunits for image formation are attached to a main body frame in a detachable manner with a positional relationship that at least one of the subunits is located at such a position as to obstruct an operation of replacing another, comprising to remove at least part of the subunits:

canceling at least a state that an outside subunit that obstructs an operation of replacing an inside subunit is fixed to an associated positioning portion and releasing the outside subunit from the positioning portion; and canceling a state that the inside subunit is fixed to an associated positioning portion and releasing the inside subunit from the positioning portion at the same as or after at least the outside subunit is being released, wherein the inside subunit is a unit including a photoreceptor and the outside subunit is an intermediate transfer member or a sheet transport belt.

5. A subunit attaching structure of an image forming apparatus in which plural subunits for image formation are attached to a main body frame in a detachable manner with a positional relationship that at least one of the subunits is located at such a position as to obstruct an operation of replacing another, comprising:

positioning portions that are provided on the main body frame and position the respective subunits; and a subunit fixing mechanism that is used in positioning at least part of the subunits being in a released state with respect to the associated positioning portions and fixing the former to the latter, and that holds at least an outside subunit that obstructs an operation of replacing an inside subunit at a prescribed releasing position and moves the outside subunit from the prescribed releasing position to a prescribed, positioning and fixing position, wherein the inside subunit is a unit including a photoreceptor and the outside subunit is an intermediate transfer member or a sheet transport belt.

6. The subunit attaching structure according to claim 5, wherein the subunit fixing mechanism is used in positioning each of the subunits with respect to the associated positioning portion and fixing the former to the latter, and holds each of the subunits at a prescribed releasing position and moves each of the subunits from the prescribed releasing position to a prescribed, positioning and fixing position.

7. The subunit attaching structure according to claim 5, wherein the subunit fixing mechanism operates according to a prescribed fixing procedure.

8. A subunit attaching method of an image forming apparatus in which plural subunits for image formation are attached to a main body frame in a detachable manner with a positional relationship that at least one of the subunits is located at such a position as to obstruct an operation of replacing another, comprising to attach at least part of the subunits:

positioning at least an inside subunit with respect to an associated positioning portion and fixing the former to the latter; and positioning, with respect to an associated positioning portion, an outside subunit to be located outside the inside subunit and fixing the former to the latter, the outside subunit being fixed after at least the positioning of the inside subunit is being fixed, wherein the inside subunit is a unit including a photoreceptor and the outside subunit is an intermediate transfer member or a sheet transport belt.

9. A subunit attaching structure of an image forming apparatus in which plural subunits for image formation are attached to a main body frame in a detachable manner with a positional relationship that at least one of the subunits is located at such a position as to obstruct an operation of replacing another, comprising:

positioning portions that are provided on the main body frame and position the respective subunits;

a subunit releasing mechanism that is used in releasing at least part of the subunits from a state that they are positioned with respect to and fixed to the associated positioning portion, and that moves at least an outside subunit that obstructs an operation of replacing an inside subunit from a prescribed, positioning and fixing position to a prescribed releasing position; and a subunit fixing mechanism that is used in positioning at least part of the subunits being in a released state with respect to the associated positioning portions and fixing the former to the latter, and that holds at least the outside subunit that obstructs an operation of replacing the inside subunit at the prescribed releasing position and moves the outside subunit from the prescribed releasing position to the prescribed, positioning and fixing position, wherein the subunit releasing mechanism and the subunit fixing mechanism are a single mechanism, and wherein the inside subunit is a unit including a photoreceptor and the outside subunit is an intermediate transfer member or a sheet transport belt.

10. The subunit attaching structure according to claim 1, wherein the subunit releasing mechanism has a fixing force generating portion that generates fixing force for positioning and fixing the subunits.

11. A subunit attaching structure of an image forming apparatus in which a subunit for image formation is attached to a main frame body in a detachable manner, comprising a positioning portion that is provided on the main body frame and positions the subunit, the positioning portion comprising an axial movement prohibiting portion that prohibits in advance axial movement of the subunit before the subunit is positioned, wherein the subunit is a unit including a photoreceptor.

12. A subunit attaching structure of an image forming apparatus in which a subunit for image formation is attached to a main frame body in a detachable manner, comprising:

a two-direction positioning portion that prohibits movement of the subunit in a height direction and a horizontal direction on the main body frame; and a one-direction positioning portion that prohibits movement of the subunit only in the height direction, wherein the subunit is first positioned with respect to the two-direction positioning portion and the subunit is then positioned with respect to the one-direction positioning portion, and wherein the subunit is an intermediate transfer member or a sheet transport belt.

* * * * *